US011771221B1

(12) United States Patent
Crolley

(10) Patent No.: US 11,771,221 B1
(45) Date of Patent: Oct. 3, 2023

(54) MOTION-CONTROLLED WALL-MOUNTED STORAGE PRODUCTS

(71) Applicant: Novare Products LLC, Bryant, AR (US)

(72) Inventor: C. Wayne Crolley, Bryant, AR (US)

(73) Assignee: Novare Products LLC, Bryant, AR (US)

( * ) Notice: Subject to any disclaimer, the term of this patent is extended or adjusted under 35 U.S.C. 154(b) by 0 days.

(21) Appl. No.: 17/731,507

(22) Filed: Apr. 28, 2022

(51) Int. Cl.
*A47B 51/00* (2006.01)

(52) U.S. Cl.
CPC ..... *A47B 51/00* (2013.01)

(58) Field of Classification Search
CPC ..... A47B 51/00; A47B 46/00; A47B 46/005
See application file for complete search history.

(56) References Cited

U.S. PATENT DOCUMENTS 2,547,597 A * 4/1951 Roggero ..... A47B 51/00 312/307
2,555,254 A 5/1951 Stebbins
3,224,827 A * 12/1965 Foster ..... A47B 46/005 312/266
4,076,351 A 2/1978 Wyant
4,915,461 A * 4/1990 Kingsborough ..... A47B 77/10 312/247
5,249,858 A 10/1993 Nusser
6,367,898 B1 * 4/2002 Jobe ..... A47B 51/00 312/246
7,770,986 B1 * 8/2010 Simaitis ..... A47B 46/005 312/246
7,922,268 B2 * 4/2011 Weber ..... A47B 46/005 312/246
8,414,093 B2 4/2013 Moran
8,424,693 B1 4/2013 Hoover
8,424,983 B1 * 4/2013 Strauss ..... A47B 51/00 312/247
10,034,540 B1 * 7/2018 Abbott ..... A47B 77/10
10,561,235 B1 2/2020 Abbott
(Continued)

FOREIGN PATENT DOCUMENTS

WO 2008108685 A1 9/2008

OTHER PUBLICATIONS

AliExpress, Cabinet pull basket: double storage, refrigerator top cabinet pull-down basket, cabinet buffer lift pull-down basket machine, https://www.aliexpress.com/item/32912588688.html.

*Primary Examiner* — Daniel J Rohrhoff
(74) *Attorney, Agent, or Firm* — Richard Blakely Glasgow

(57) ABSTRACT

A motion controlled wall-mountable storage product including a storage product, such as a cabinet or a shelf, having a wall-mountable portion and a moveable portion operable to store goods. A series of plates lowers and raises the moveable portion for easy access to the store goods. A set of first plates is connected to the wall-mountable portion. Each of the first plates is moveable in a first direction relative to the wall-mountable portion. A set of second plates is connected to the set of first plates, and each of the second plates is moveable in a second direction relative to the set of first plates. A set of third plates connected to the set of second plates, and each of the third plates is moveable in a third direction relative to the set of second plates. The moveable portion of the storage product is connected to the set of third plates.

21 Claims, 33 Drawing Sheets

(56) References Cited

U.S. PATENT DOCUMENTS

| | | | | |
|---|---|---|---|---|
| 10,973,319 | B2 | 4/2021 | Eames | |
| 2011/0266937 | A1* | 11/2011 | Roberts | F16M 11/048 16/400 |
| 2012/0313494 | A1* | 12/2012 | Chow | A47B 51/00 312/298 |
| 2014/0263122 | A1* | 9/2014 | Roberts | A47B 46/005 211/88.01 |
| 2017/0224107 | A1* | 8/2017 | Freelander | A47B 96/06 |
| 2018/0014637 | A1* | 1/2018 | Villegas | A47B 46/005 |
| 2022/0167740 | A1* | 6/2022 | Sharma | A47B 51/00 |

* cited by examiner

MOTION-CONTROLLED WALL-MOUNTED STORAGE PRODUCTS

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

The wall-mounted cabinet has remained unchanged for hundreds of years. Cabinets and shelves at inaccessible heights can be found in many homes and offices, as well as in healthcare, recreational and government facilities. Accessibility Guidelines in the Americans with Disabilities Act stipulates that for shelves to be accessible for people in wheelchairs they are to be no higher than 48 inches, however, there are currently no solutions for accessible shelving above a 48-inch height. Even in this era of innovation, we have still not solved the problem of accessing shelves that are beyond physical reach.

It would therefore be desirable to develop wall-mounted storage products, such as cabinets and shelves, having a motion control system for lowering and raising the cabinets and shelves.

BRIEF SUMMARY OF THE INVENTION

The present invention is directed to a motion controlled wall-mountable storage product including a storage product having a wall-mountable portion and a moveable portion operable to hold goods. A set of first plates is connected to the wall-mountable portion. Each of the first plates is moveable in a first direction relative to the wall-mountable portion. A set of second plates is connected to the set of first plates, and each of the second plates is moveable in a second direction relative to the set of first plates. A set of third plates is connected to the set of second plates, and each of the third plates is moveable in a third direction relative to the set of second plates. The moveable portion of the storage product is connected to the set of third plates.

The storage products, such as cabinets and shelves, include a non-moveable wall-mounted portion and a moveable portion. A motorized motion control system is used to lower the moveable portion from its high position on the wall to a fully accessible lower level. The system uses automation to safely lower the moveable portion to within arm's reach. The motion-controlled storage product is connected over the Internet to an assistive support center and offers add-on digital services. The storage product uses a series of plates, each designed to allow the moveable portion to move in a specific direction and distance by extending one plate at a time, to move the moveable portion of the storage product to a predetermined position. These plates are attached to each other in an assembly that allows each plate to slide in a specific direction. The storage product may be mounted to a wall by a cabinet installer, plugged in to a residential wall outlet, and turned on. In operation, the storage product may be lowered as much as 36 inches, such as from 72 inches above the floor to 36 inches above the floor. To increase the distance the moveable portion can be lowered, the storage product can be designed with additional moveable plates, thereby increasing the overall total lowering distance possible. To decrease the distance the moveable portion can be lowered, a button can be pressed to halt the lowering operation at the preferred height or the storage product can be designed with fewer moveable plates, thereby decreasing the overall total lowering distance possible.

The storage product of the present invention lowers above head-height storage to a more accessible level, uses residential electricity, is installed like conventional wall-mounted cabinets, can be mounted on a reinforced shelf, on a wall, or on a custom rack, and includes an audible and visual safety alarm that alerts users when the cabinet is in motion.

These and other features, objects and advantages of the present invention will become better understood from a consideration of the following detailed description of the preferred embodiments and appended claims in conjunction with the drawings as described following:

BRIEF DESCRIPTION OF THE DRAWINGS

FIG. 3A shows the storage product in the high position, FIGS. 3B-3D show the storage product moving from the high position to low position, and FIG. 3E shows the storage product in the low position.

FIG. 8A shows the storage product in the high position, FIGS. 8B-8C show the storage product moving from the high position to the low position, and FIG. 8D shows the storage product in the low position.

FIG. 10A shows the storage product in the high position, FIGS. 10B-10C show the storage product moving from the high position to low position, and FIG. 10D shows the storage product in the low position.

FIG. 13A is a side view of the outer surface of the first plate, and FIG. 13B is a side view of the inner surface of the first plate. FIG. 13C is a side view of the inner surface of the second plate, and FIG. 13D is a side view of the outer surface of the second plate. FIG. 13E is a side view of the inner surface of the third plate, and FIG. 13F is a side view of the outer surface of the third plate. FIG. 13G is a side view of the right side of the moveable portion of the storage product, and FIG. 13H is a side view of the left side of the moveable portion of the storage product.

DETAILED DESCRIPTION OF THE INVENTION

Figure 1:
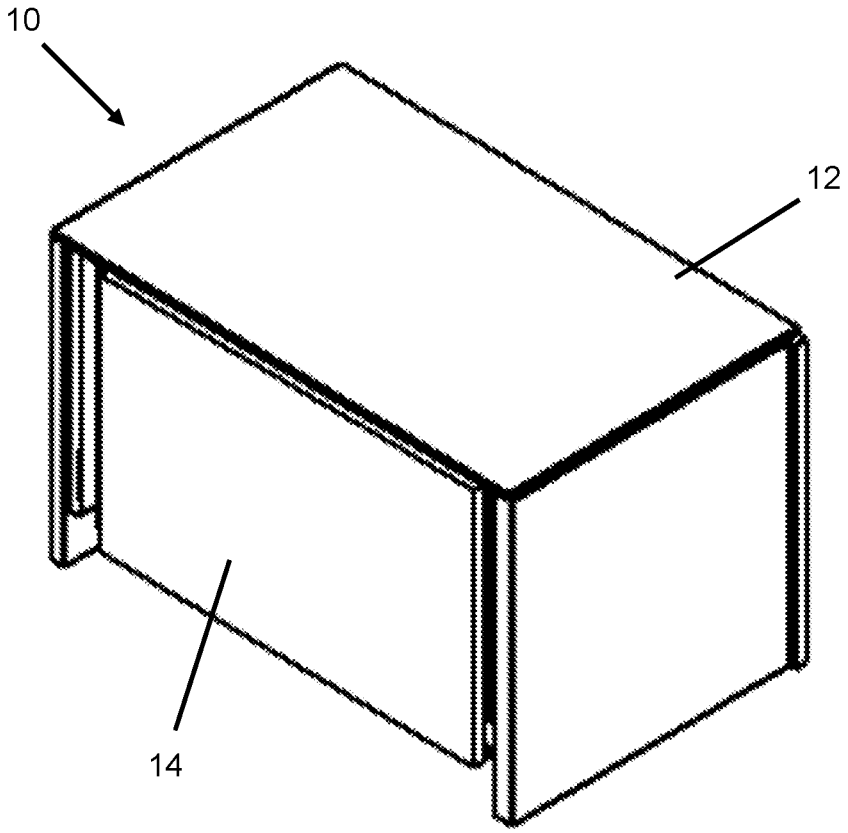
FIG. 1 is a perspective view of the storage product of the first embodiment of the present invention in the high position.

With reference to FIGS. 1-15B, the preferred embodiments of the motion controlled wall-mounted storage product of the present invention may be described.

The storage product 10 (e.g., shelf, open cabinet, enclosed cabinet, etc.) includes a non-moveable, wall-mounted portion 12 and a moveable portion 14 for holding goods that can be lowered. The storage product includes a series of plates (e.g., first plate 24, second plate 26, and third plate 28) designed to move the moveable portion 14 in a specific direction by extending the plates attached to the plate 30 of the moveable portion 14 one at a time. The plates are designed in a telescoping manner with the plates attached one inside the other. The plates are used in pairs with one attached to each side of the moveable portion 14. Each pair of plates slides in a specific direction in sequence relative to the other pairs of plates. Each plate provides a different direction and distance of travel, which is controlled by pegs 16 or rails 18 traveling through slots 20 in each of the plates. Each slot 20 is cut into the plate at an angle of travel that is needed. Collectively, as a peg 16 or rail 18 travels through each slot 20 in the opposing plate, the end result is a controlled direction of travel of the moveable portion of the storage product to a predetermined position. With the exception of plate 22, which is a part of the non-moveable portion 12 of the storage product, the plates with the attached moveable portion 14 of the storage product are lowered to an accessible position using gravity. The speed of the lowering of the storage product is controlled by maintaining the tension of a cable 36 that is connected to a cable drum 66 that is controlled by a motor 34.

Figure 2:
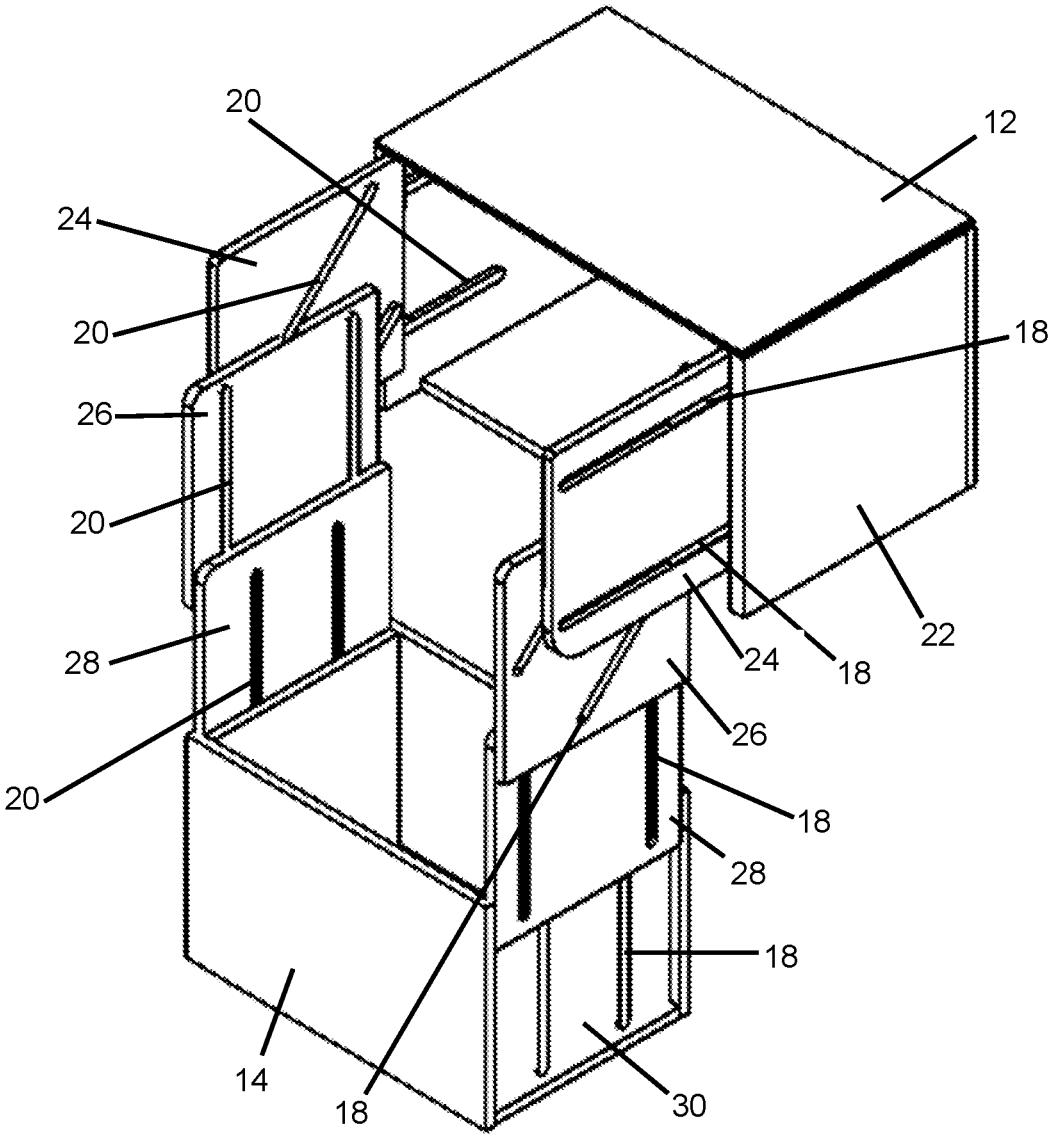
FIG. 2 is a perspective view of the storage product of the first embodiment of the present invention in the low position.

The plates are preferably square or rectangular shaped. Each pair of plates (e.g., right first plate 24 and left first plate 24) is designed to move a specific direction and a specific distance. The plates combined and synchronized movement operate to lower the moveable portion 14 of the storage product from a high level or position to a low level or position. At the high level as shown in FIG. 1, both the non-moveable 12 and moveable portions 14 of the storage product are positioned high on the wall. At the low level as shown in FIG. 2, the moveable portion 14 of the storage product is much lower than the non-moveable portion 12 of the storage product. Each movement of the storage product is the result of the interaction of two pairs of plates. One plate pair has rails 18 that extend perpendicular along the side of the plate, and the other plate pair has slots 20 in the side of the plates. When these two plates are placed side by side so that the rail 18 fits into the slot 20 and force is then applied, the plates with the rails move in a direction controlled by the angle of the slots in the side of the other plates.

Figure 3A:
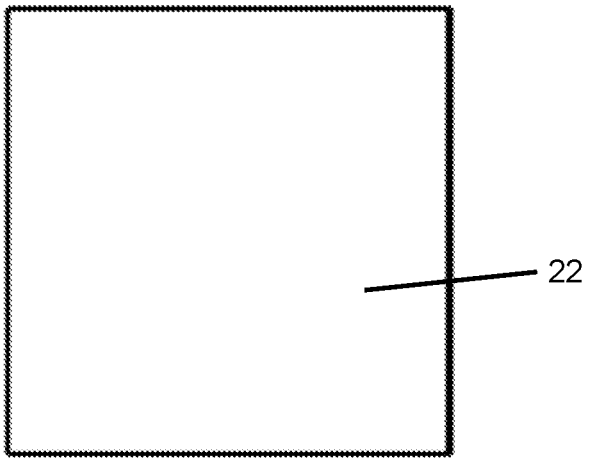
FIGS. 3A-3E are side views of the storage product of the first embodiment of the present invention transitioning from the high position to the low position in five sequential steps.
Figure 3B:
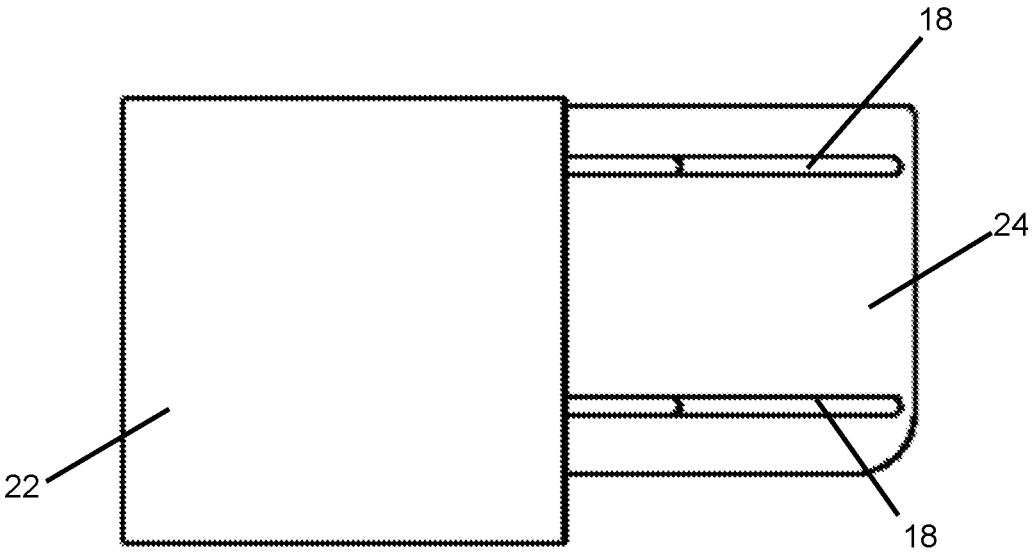
Figure 3C:
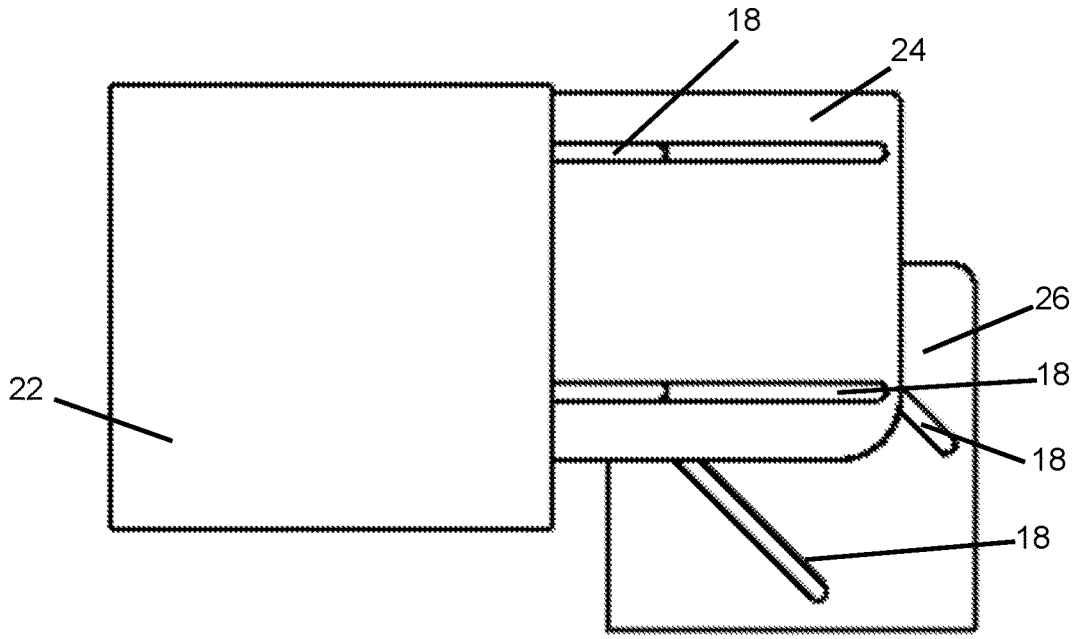
Figure 3D:
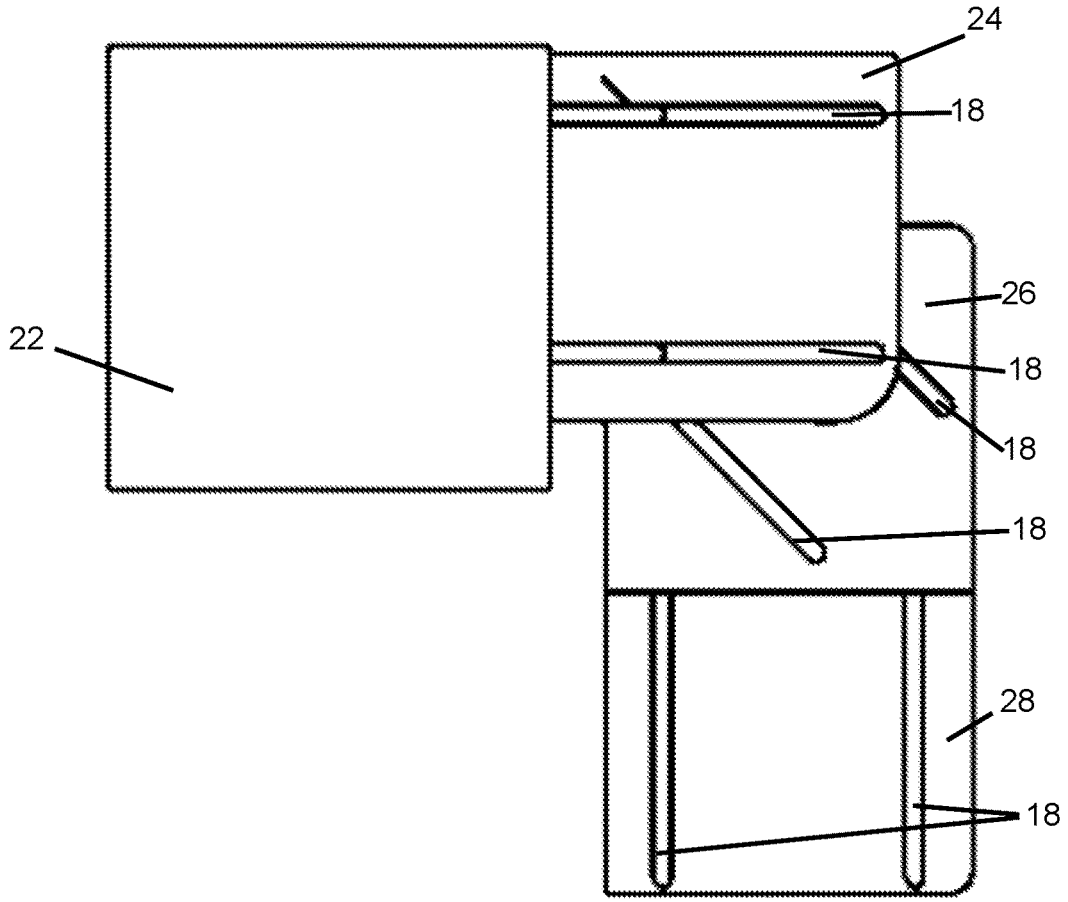
Figure 3E:
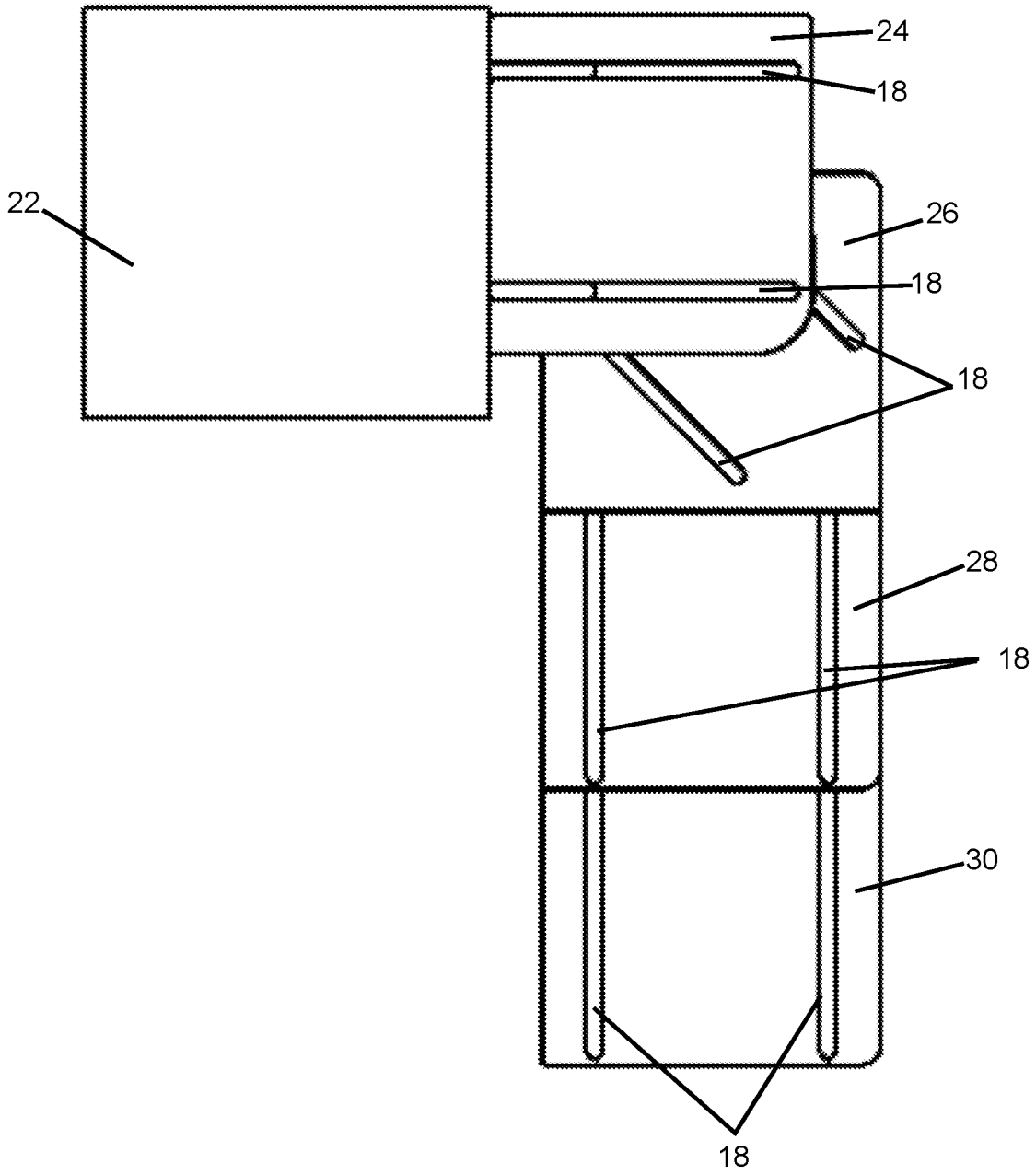
Figure 4:
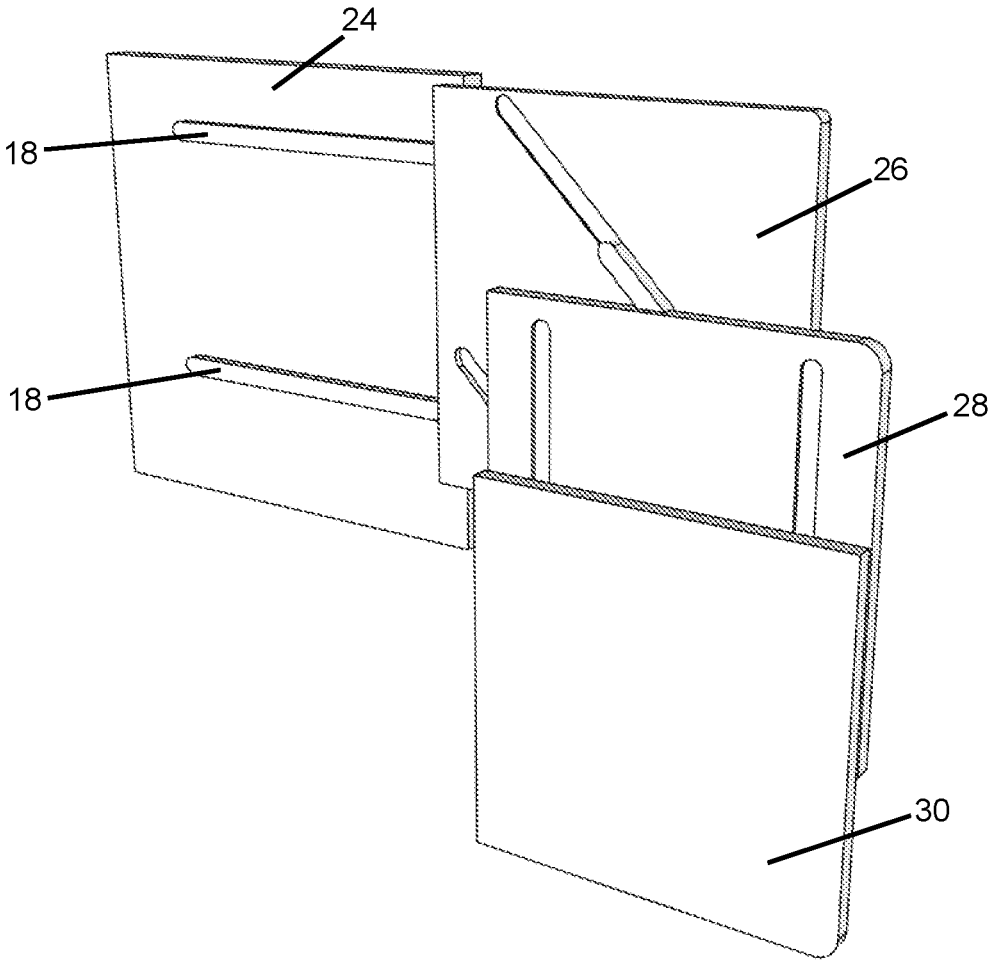
FIG. 4 is a perspective view of the slots in the plates of the motion control system of an alternative first embodiment of the present invention.

The first embodiment of the storage product is shown in FIGS. 1-3E. An alternative first embodiment is shown in FIG. 4. The sequence of movements of the plates using guide rails 18 and guide slots 20 is shown in FIGS. 3A-3E. In one embodiment, the guide rails 18 are T-shaped and the guide slots 20 are T-shaped for a secure locking configuration. Plate 22, which is the outer wall of the non-moveable portion 12 of the storage product, has two horizontal slots 20 on the top and bottom of its inner surface. First plate 24 has two horizontal rails 18 on the top and bottom of its outer surface that fit into the horizontal slots 20 on plate 22 of the non-moveable portion. In the first step, as shown in FIG. 3A, first plate 24 is positioned entirely inside plate 22. In the second step, force is applied to first plate 24 by motor 32 inside the non-moveable portion 12 of the storage product. As a result, first plate 24 is pushed horizontally outward by the rails 18 of first plate 24 moving through the horizontal slots 20 in plate 22 of the non-moveable portion, as shown in FIG. 3B.

First plate 24 has two angular slots 20 in its inner surface, and second plate 26 has two complementary angular rails 18 on its outer surface that fit into the angular slots 20 in first plate 24. The rails 18 of second plate 26 are moveable within the angular slots 20 of first plate 24. In one embodiment, a second motor, motor 34, is located inside the non-moveable portion 12 of the storage product and is connected to a cable drum. The cable drum includes a cable 36 that is connected to the moveable 14 portion of the storage product. When motor 34 is activated, cable tension is released which allows the plates to lower. As shown in FIG. 3C, when the cable tension is released, second plate 26 falls under its own weight and the weight of the contents in the moveable portion 14. In doing so, the rails 18 of second plate 26 are pulled by gravity in an angular and downward direction through the slots in first plate 24. The angular movement is important because it moves the moveable portion 14 out and away from any object that is located directly underneath the storage product.

Second plate 26 has two vertical slots 20 in the left and right sides of its inner surface. Third plate 28 has two vertical rails 18 on its left and right outer surface that fit into the vertical slots 20 on second plate 26. The rails 18 of third plate 28 are moveable within the vertical slots 20 on second plate 26. As shown in FIG. 3D, third plate 28 falls under its own weight and the weight of the contents in moveable portion 14. In doing so, the rails 18 of third plate 28 are pulled by gravity in downward direction through the slots 20 in second plate 26. The guide slots 20 in the inner surfaces of plate 22 of the non-moveable portion, first plate 24, and second plate 26 are shown in FIG. 4. Because second plate 26, third plate 28, and the moveable portion 14 of the storage product (which includes fourth plate 30 in this embodiment) would be free to fall at the same time once second plate 26 clears the non-moveable portion 12 of the storage product, cable tension must be used to control their movement.

When motor 34 is activated to rotate the cable drums in reverse, cable tension is created. As a result, second plate 26 and third plate 28 are pulled upward. The bottom of the plates includes a stop edge that catches on the plate above it when the plates are being raised. Once second plate 26 and third plate 28 are pulled upward and parallel with first plate 24, motor 32 activates in reverse and pulls the plates horizontally inward into the non-moveable portion 12 of the cabinet. The various plates, motors, cables/cable drum, and related components may collectively be referred to as the motion control system.

The second embodiment of the invention is shown in FIGS. 5A-7 and FIGS. 13A-H. In this embodiment, the pairs of plates form boxes that are arranged to move in a telescoping manner with the plate pairs (or boxes) one inside the other. For example, when the storage product 10 is in the high position, the non-moveable portion 12 of the storage product contains first plate 24, which contains second plate 26, which contains third plate 28. In this embodiment, in addition to the guide rails 18 and guide slots 20 described in the first embodiment, the storage product also uses pegs 16 and slots 20 for controlled movement. The inner surface and outer surface of first plate 24, second plate 26, third plate 28, and fourth plate 30 are shown in FIGS. 13A-H. The sequence of movements of the plates using pegs 16 and slots 20 is shown in FIGS. 5A-5D. Two pegs 16 are positioned on each of the left and right sides of the moveable portion 14 of the storage product. First plate 24 has two angular slots 20 in its inner surface. The pegs of the moveable portion fit into the two angular slots of the first plate 24 and are moveable with the slots 20 of first plate 24. When motor 34 is activated and cable tension is released, second plate 26 falls under its own weight and the weight of the contents of the moveable portion 14. In doing so, second plate 26 travels in an angular and downward direction as the pegs 16 travel in the slots 20 in first plate 24, as shown in FIG. 5B.

Figure 5A:
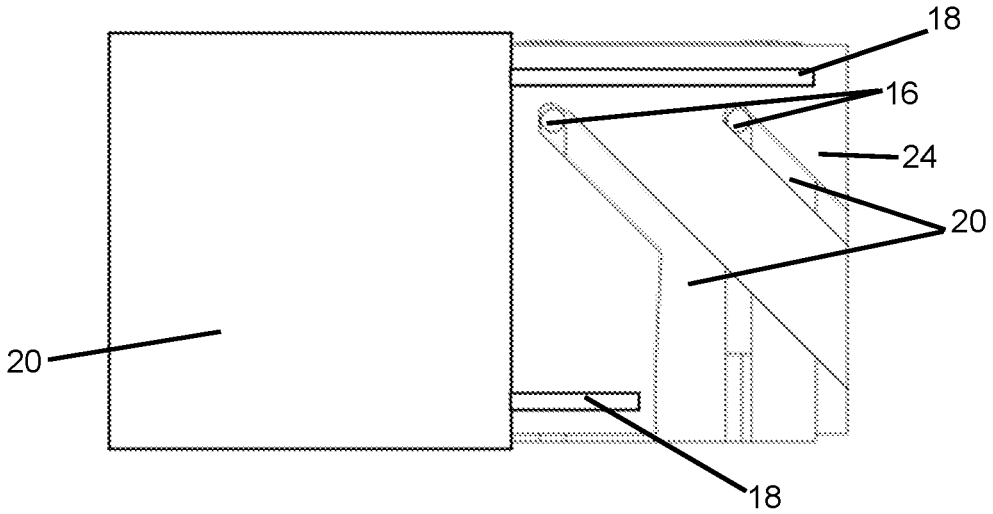
FIGS. 5A-5C are side views of the storage product of the second embodiment of the present invention transitioning to the low position in three sequential steps using pegs and slots.
Figure 5B:
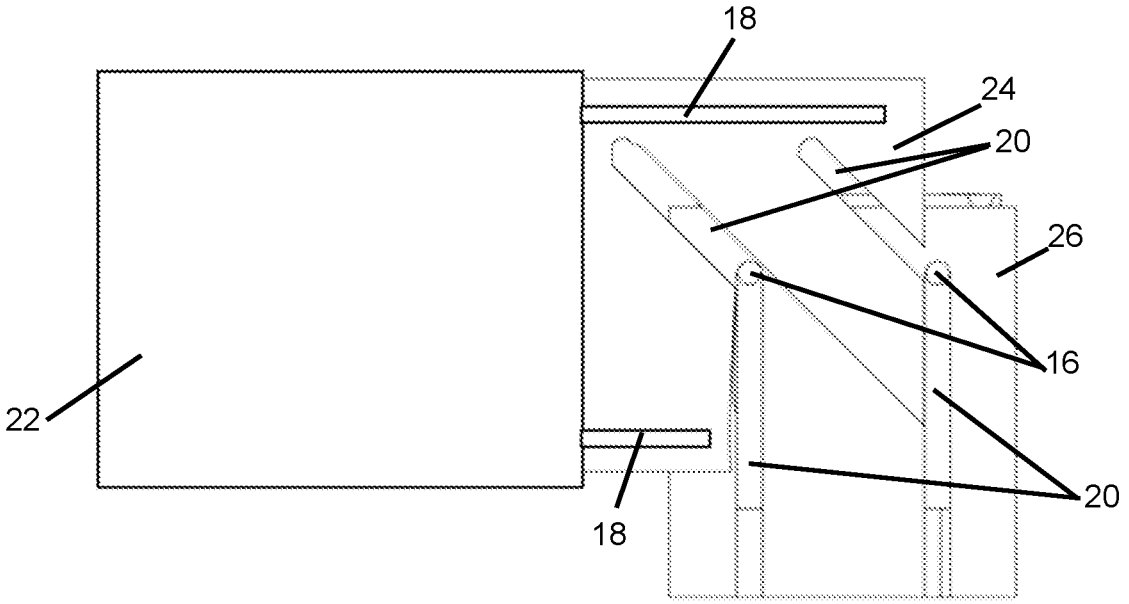
Figure 5C:
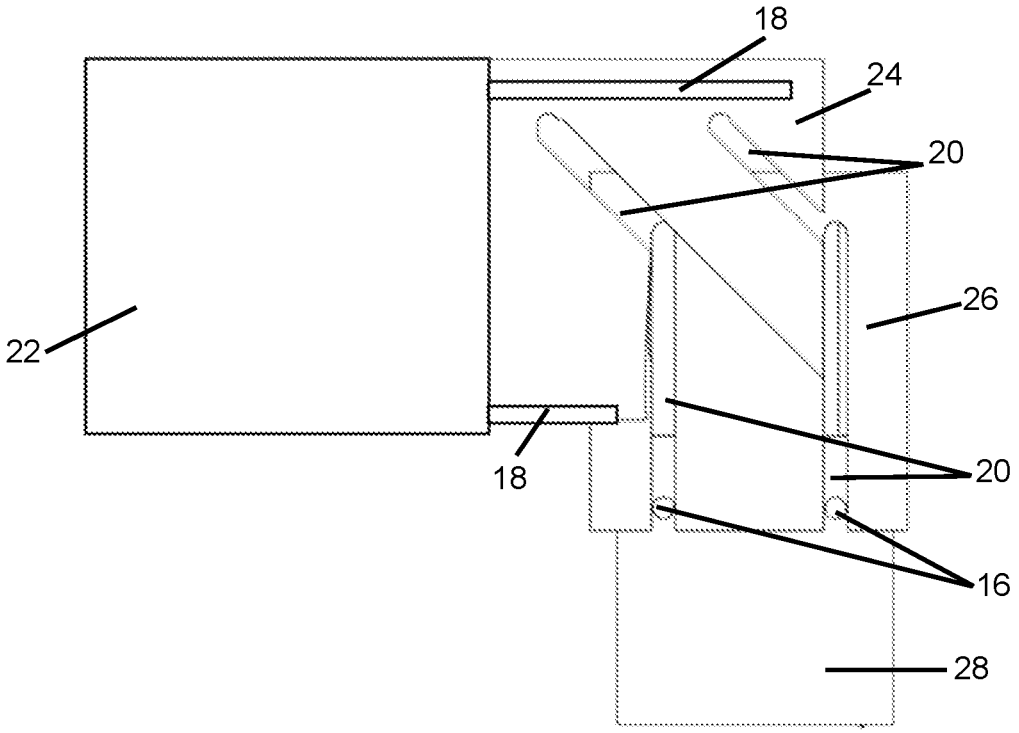
Figure 5D:
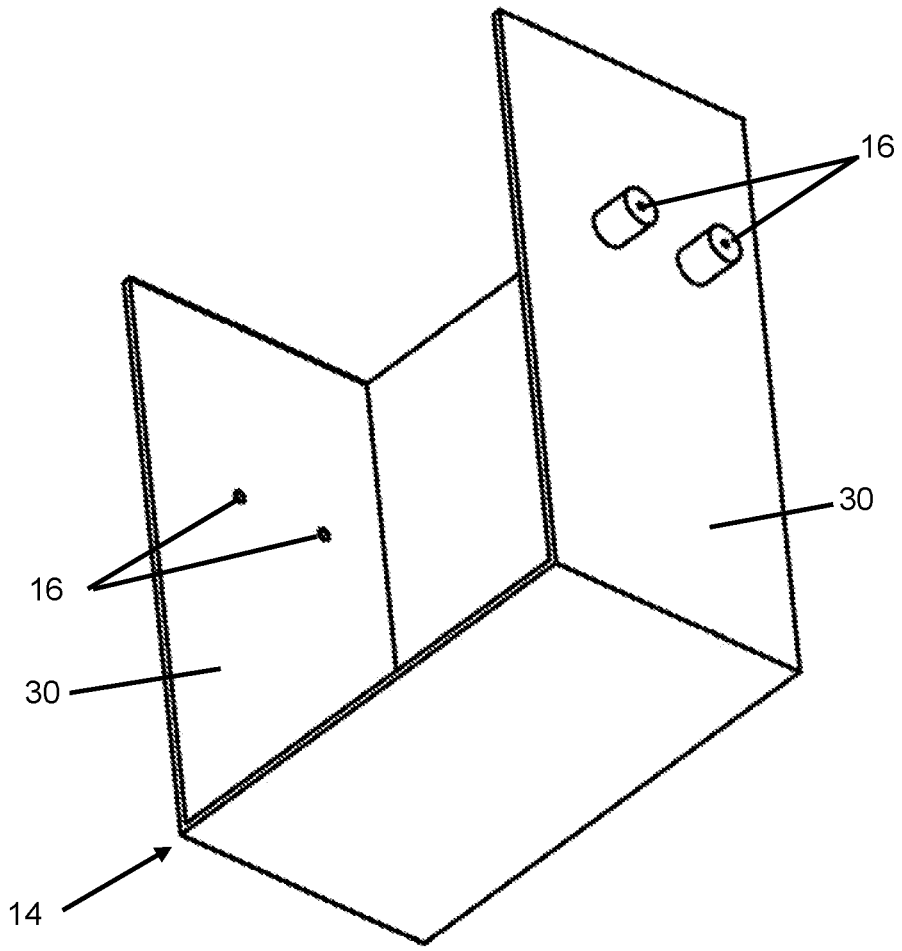
FIG. 5D is a perspective view of the moveable portion of the storage product.

Second plate 26 has two vertical slots 20 in its inner surface. The same two pegs fit into the vertical slots 20 of second plate 26 and are moveable within the vertical slots 20 of second plate 26. Third plate 28 then falls under its own weight and the weight of the contents of the moveable portion 14. In doing so, the pegs 16 travel in a vertical downward direction in the slots 20 of the second plate 26 until the desired end position is reached, as shown in FIG. 5C. The same movement of the two pegs 16 on the opposite side of the storage product 10 occurs simultaneously. As described above, the pegs 16 and slots 20 control the distance and direction of movement of the plates and the attached moveable portion 14 of the storage product. The use of the pegs 16 and slots 20 is important because it alleviates the need for servos and other electronic and software components that might otherwise be needed to change the direction of the plates. This reduces the overall complexity and cost of the system. In this embodiment, the slots 20 in the plates guide the direction and distance of the pegs 16 based on the angle and length of the slots 20. And unlike in the first embodiment, second plate 26, third plate 28, and the moveable portion 14 of the storage product (which includes fourth plate 30 in this embodiment) cannot move at the same time. As shown in FIGS. 5A-5C, the pegs 16 are prevented from moving in a different direction until they reach a specific position along the length of the particular slot 20. For example, the pegs 16 cannot move downward through the slots 20 of second plate 26 until the pegs 16 reach the bottom of the angular slots 20 in first plate 24, as shown in FIGS. 5B-5C. It is in this regard that the slots 20 control both the direction and distance of travel of the pegs 16.

Figure 6:
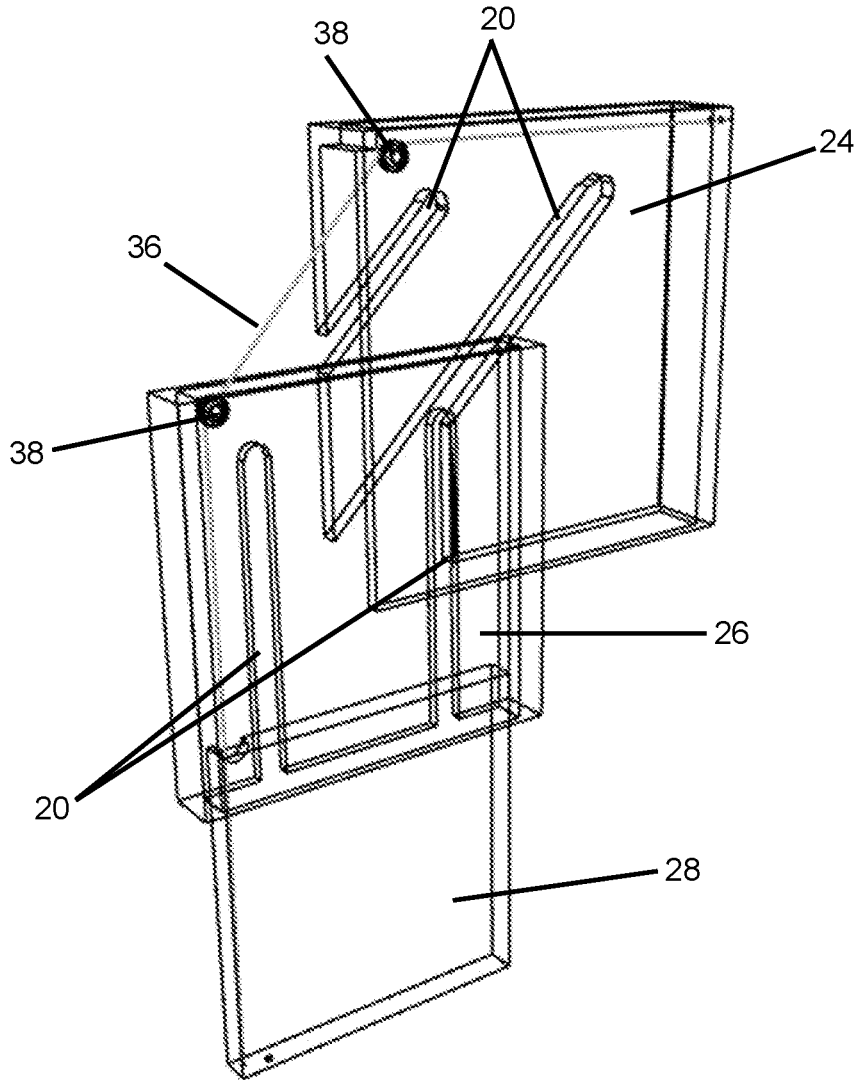
FIG. 6 is a see-through perspective view of the plates of the motion control system of the second embodiment of the present invention.
Figure 7:
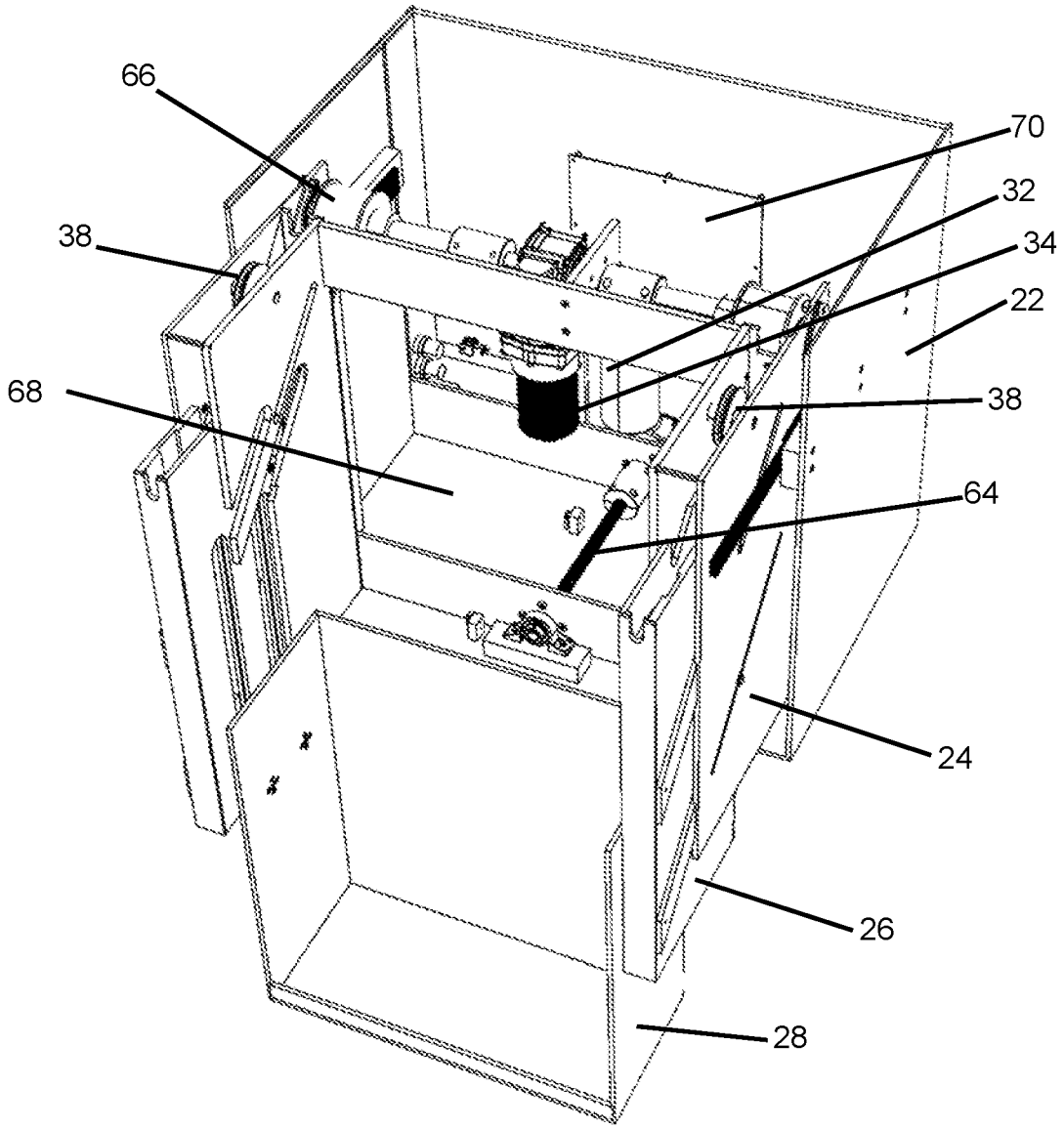
FIG. 7 is a perspective view of the storage product of the second embodiment of the present invention.

The plates and the moveable portion 14 of the storage product may be lowered and raised by (1) a motorized system with a cable 36 and pulleys 38 or (2) a manual system with a cable 36 and pulleys 38. FIG. 6 shows the connections between the plates 24, 26, 28, cable 36, and pulley 38. The motorized system includes one or more electric motors 32, 34, cables 36, and pulleys 38. The cable 36 is connected at one end to an electric motor 34 and travels over a pulley or pulleys 38. The cable 36 is connected at the other end to the last plate in the series of plates. The electric motor 34 turns a cable drum 66, which releases tension on the cable 36. Then, using gravity, the moveable portion 14 of the storage cabinet to which the plates are connected is lowered. FIG. 7 shows the components of the motorized system, including the worm gear 64 that is connected to motor 32 to push the moveable portion 14 of the storage product out of the non-moveable portion 12 before the moveable portion 14 is lowered and then to pull the moveable portion 14 back into the non-moveable portion 12. The printed circuit board 70 contains the microcontroller, DC to DC power supplies, motor controller circuitry, limit switch inputs, rotary encoder inputs, and the required programming circuitry and firmware. Two limit switches 68 are used to detect the beginning and ending movement of the moveable portion of the storage product. One limit switch 68 is installed in the position to detect when the moveable portion is fully lowered, and another limit switch 68 is installed in the position to detect when the moveable portion is fully raised. When activated, the limit switch 68 uses an electrical signal to transmit to the circuit board 70, which in turn instructs the motors 32, 34 to cease operating. A different physical location of the limit switch 68 along the travel path of the moveable portion of the storage product may be selected to activate the limit switch 68 and send a signal to the circuit board 70, which in turn signals the motors 32, 34 to cease rotating, ceasing the retraction or releasing of the cables 36, at which point the moveable portion of the storage product ceases movement.

In a manual system, a person pulls on the moveable portion 14 of the storage product with enough force to cause the moveable portion 14 and the plates to move from the high level to the low level. As force is applied, each plate moves in its designed direction, which eventually causes the moveable portion 14 to move outward, then downward at an angle, and then straight downward. A cable 36 is used to connect the plates. The cable is connected at the opposite end to a spring-loaded cable drum (or spring reel) 66. The cable drum 66 serves to slow the descent of the moveable portion 14 of the storage product as force is being applied to lower it and to aid in the raising of the moveable portion 14 to its original position.

The dimensions of the plates (height and depth) can be changed to achieve a different distance of travel of the moveable portion 14 of the storage product. For example, an assembly of rectangular plates will extend further downward than an assembly of square plates. As a result, the dimensions of the plates can be changed to achieve as much or as little travel distance desired. Increasing or decreasing the plate dimensions also impacts the dimensions and capacity of the moveable portion of the storage product attached to the plates. The depth of the plates can be increased to create a longer distance of travel outward and at a downward angle. In most cases, the dimensions of the plates are the same as the dimensions of the overall product. There are limitations to the dimensions that can be used especially when the storage product is to be mounted in a place with limited available space.

EXAMPLE: The inventor built and tested a prototype of the storage product of the present invention. The prototype product was a wall-mounted cabinet. The prototype lowered its storage cabinet (i.e., the moveable portion of the cabinet) just over 35 inches. The approximate outside dimensions of the prototype when closed were 18" deep, 27" wide, and 24" high. The weight of the prototype was approximately 85 pounds. The storage cabinet was made of two parts: the storage cabinet and the storage cabinet pegs. The storage cabinet was made of plywood to minimize the weight while retaining strength. Four pieces of plywood were joined using rabbet joints, wood glue, and finishing nails to form the storage cabinet. The internal dimensions of the storage cabinet were approximately 9⅜" deep, 15.75" wide, and 19" high, and its nominal wall thickness was 6 mm. The plates were made primarily of plywood, but pieces of Delrin were used along the travel path to ensure smooth motion and low friction. The plywood pieces of the plates were joined using rabbet joints, wood glue, and finishing nails. The Delrin pieces were joined to the plywood using heat-staking. The nominal wall thickness of the plywood was 6 mm, and the nominal thickness of the Delrin was 1/16". The horizontal plates were mounted to the non-moveable portion of the cabinet using drawer rails which enabled the horizontal extension of the plates and the storage cabinet. The inside of the horizontal plates also had slots in which the angled plates travel along. The angled plates fit inside and traveled along slots on the inside of the horizontal plates on a 45° angle. The angled plates begin their movement after the horizontal plates are fully extended on the drawer slides and provided both horizontal and vertical extension for the storage cabinet. Each angled plate was secured to its corresponding horizontal plate with a 0.5" diameter dowel pin that is 2" long, McMaster-Carr part number 98105A103.

The Lovato LPCB7355 control station—a three button panel—was mounted to the side of the non-moveable portion of the cabinet for controlling the motion of the storage cabinet. The control station included arrows and a stop button. The visual motion notification was an RS PRO 7637918, used 24V, emitted green or red light, and was mounted on the side of the prototype. The motor used for the horizontal movement of the storage container was a Dumore model DR250 (a 3" right angle gear motor). The motor used for lowering and raising the storage container was a Dumore model DR600 (a right-angle gear motor). The prototype included a dual shaft, which allowed the lowering and raising motor to be centered between the sets of plates. This allowed for easier location of the cable drums. Loos and Co. recommended using five times the needed strength for a factor of safety for lifting wire rope. Loos recommended 1/8" wire rope as it is rated at 2000 lbs. because the next size down (3/32") was rated at only 1000 lbs.

There was one pulley for each set of the plates that the wire rope travels over. The selected pulley was McMaster-Carr part number 3434T78, which accommodates 1/8" diameter wire rope. The pulley was held in place by a 0.5" diameter and 2" long dowel pins (McMaster-Carr part number 98105A103). The power supply was a 330 W AC-DC 24V power supply (Protek Power part number PUP330N3-14). The motor speed was adjusted by a Pulse Width Modulated (PWM) signal generated by the microcontroller unit (MCU). This signal was sent independently to each of the motors.

Horizontal movements of the storage cabinet were controlled in two directions (in and out) using the horizontal motor. Vertical movements of the container were controlled in three directions (up and down and at an angle) using the vertical motor. Four limit switches provided information to the MCU about the storage cabinet position along its horizontal and vertical movements. The MCU read the switch inputs and used this information to determine when to start, stop, and transition between running the horizontal and the vertical motors. The expected operation during storage cabinet movement is that the horizontal movement occurs first and, when completed, the vertical movement is next. Only one of the motors is active at any given time. Storage cabinet raising is the same with only one motor active at a time, but the order is reversed. The selected microcontroller was the STM32G071RBT6. This microcontroller is based on the ARM Cortex MO+32-bit core operating at up to 64 MHz. It offered the standard interfaces that were needed, including: I2C, SPI, UART, ADCs, DAC, PWM, GPIO. This microcontroller specifically supports quadrature encoders, allowing for robust implementation and use of the two motor encoders. The application state machine controlled all operations of the prototype. The control of the motors, timer, User Interface (UI) buttons, UI LEDs, and audible motion notification events were handled through a single "task" in the main loop.

Figure 8A:
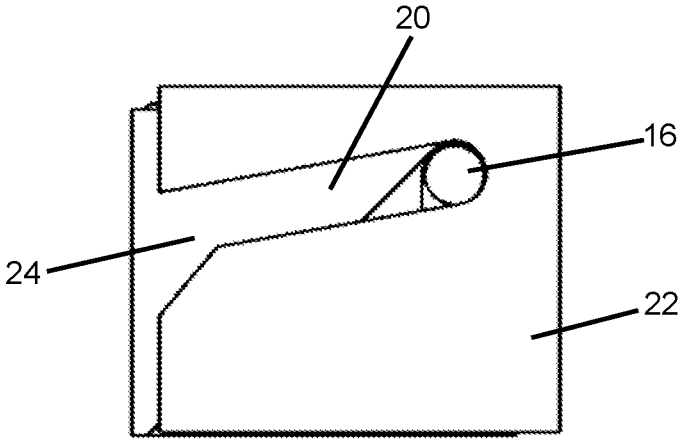
FIGS. 8A-8D are side views of the storage product of the third embodiment of the present invention transitioning from the high position to the low position in four sequential steps.
Figure 8B:
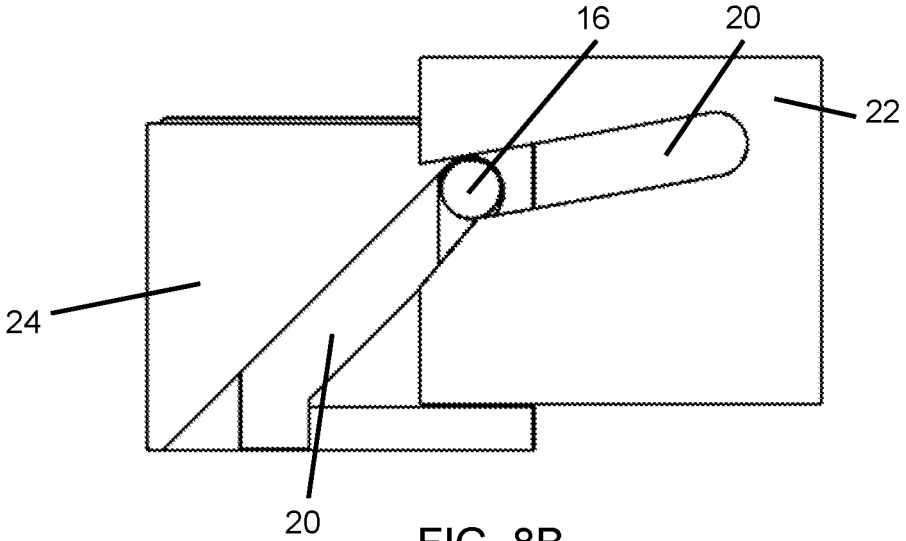
Figure 8C:
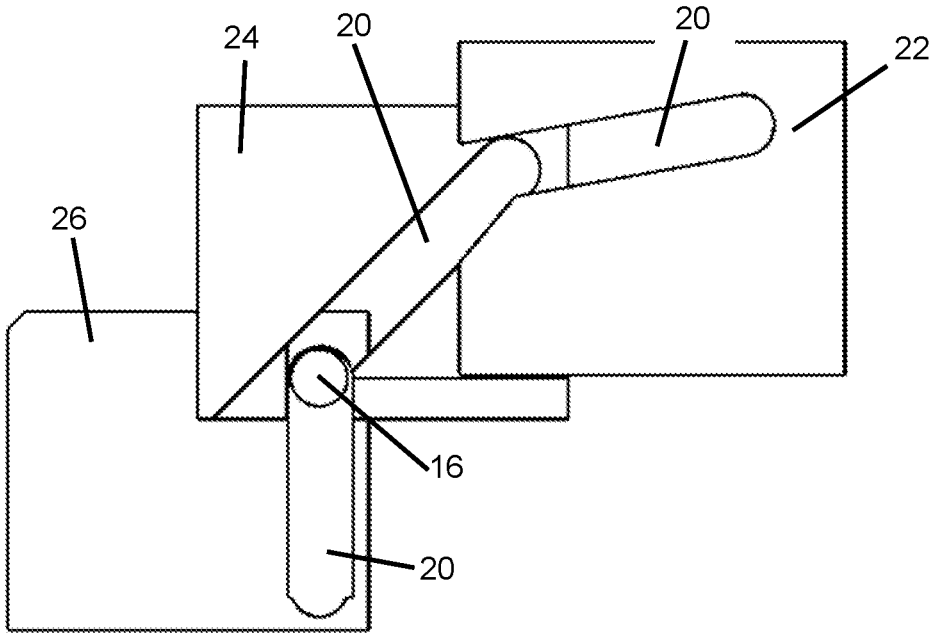
Figure 8D:
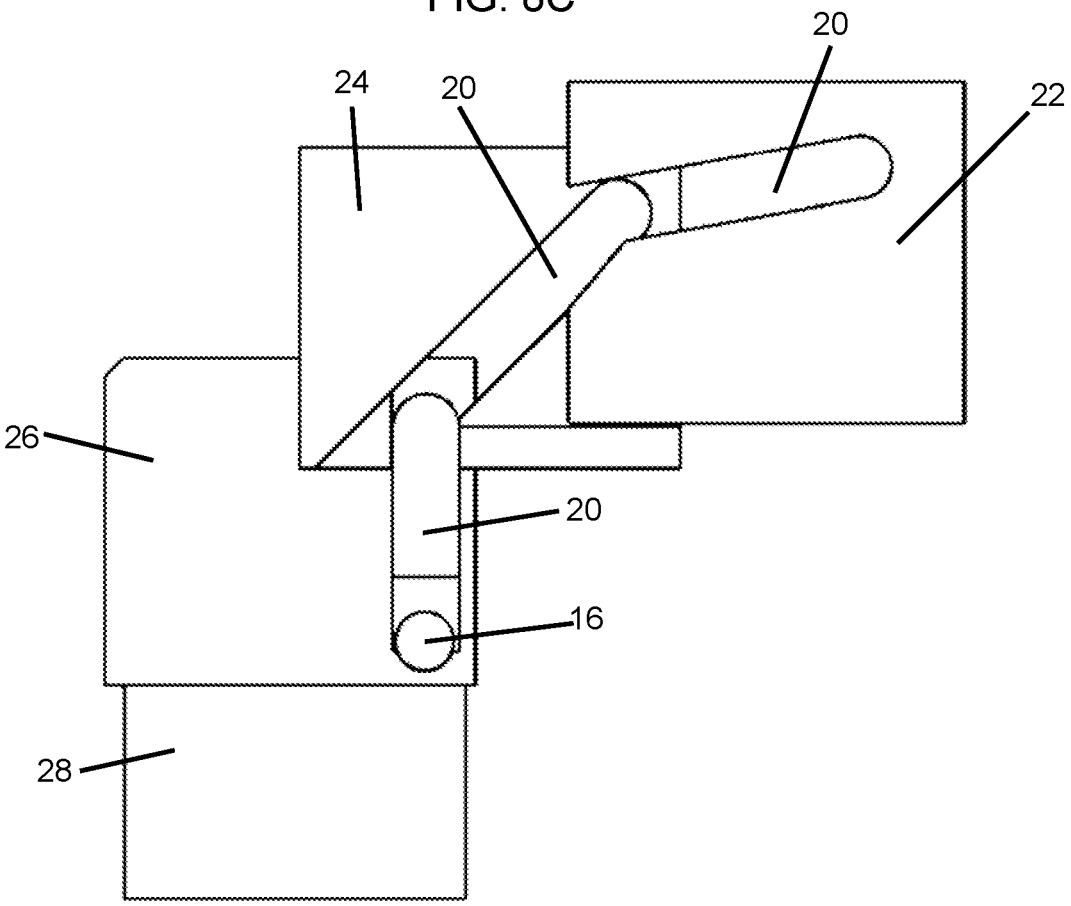
Figure 9A:
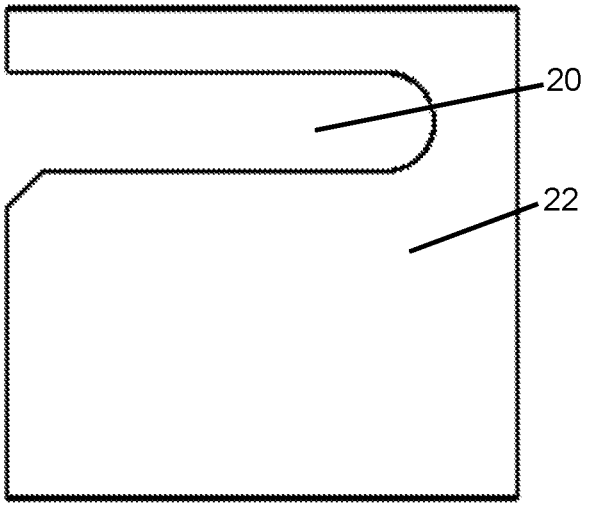
FIGS. 9A-9D are side views of the plates of the motion control system of the third embodiment of the storage product of the present invention with the plate of the non-moveable portion shown in FIG. 9A, the first plate shown in FIG. 9B, the second plate shown in FIG. 9C, and the third plate shown in FIG. 9D.
Figure 9B:
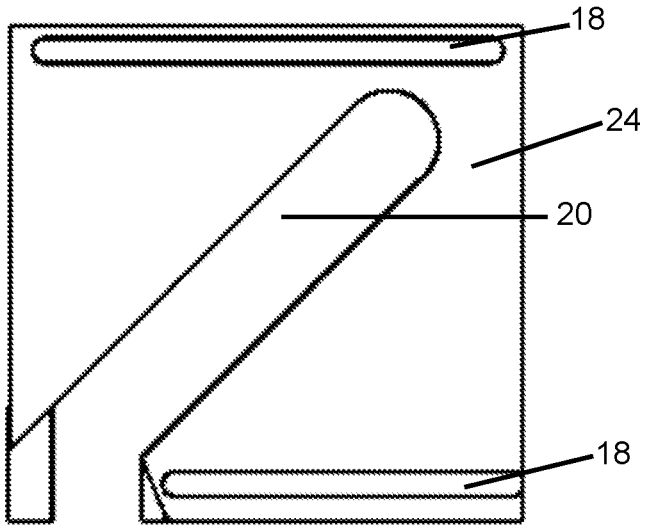
Figure 9C:
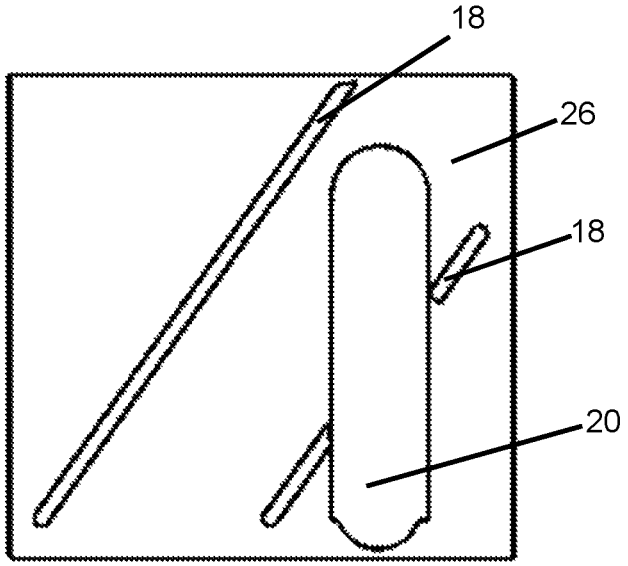
Figure 9D:
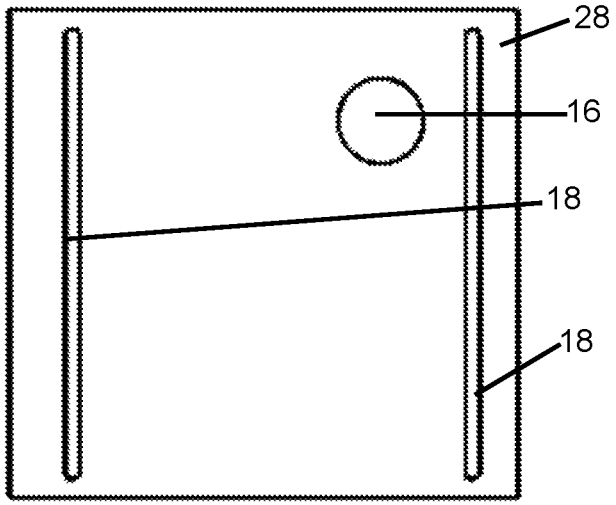

In a third embodiment, in order to reduce the cost of the system, the system only includes one motor instead of the two motors described above. In particular, this embodiment includes motor 34 but does not include motor 32. In this embodiment, the first plate 22 has a slot 20 having an approximately 10-degree downward slope instead of being horizontal, shown in FIG. 8A. This allows the plates to be pulled by gravity along this 10-degree downward slot and away from the cabinet case or non-moveable portion 12 of the storage product (as shown in FIG. 8B) to a position where the remaining plates will move as described in versions above. In this embodiment, only one motor 34 is needed that connects to two cable drums (one on each side and for each plate assembly) that releases cable tension when the user wants to lower the cabinet and creates cable tension when the user wants to return the storage container to its upper position. No motor is needed to push and pull the storage container away from the cabinet case.

As shown in FIGS. 9A-9D, a single peg or roller 16 moves through all plates in a continuous manner which allows a more fluid movement of the plates. In addition, the slots in the plates control the direction and distance of travel for the moveable portion of the storage product, as discussed above. Plate 22 of the non-moveable portion, first plate 24, second plate 26, and third plate 28 are shown in FIGS. 9A-9D.

The sequence of movements of the plates in this embodiment are shown in FIGS. 10A-10D. The storage product 10 illustrated in FIGS. 9A-10D only utilizes three plates 24, 26, 28 because only three plates are needed to lower the moveable portion 14 of the storage product to the desired position. If the moveable portion 14 needed to be lowered a greater distance, a fourth plate 30 like described in other examples could be utilized. The guide peg or roller 16 is located on the side of the moveable portion 14 of the storage product (i.e., third plate 28 in this embodiment) and travels through the slots 20 in each of the plates that control the direction of travel for the moveable portion 14. The roller 16 moves freely through all of the guide slots 20. As the guide roller 16 of the moveable portion 14 moves through each slot 20, the moveable portion 14 of the storage product is lowered to the accessible level. Plate 22 of the non-moveable portion allows the storage product to move in a horizontal direction out of non-moveable portion 12 of the storage product and into a position where the moveable portion can begin to lower. First plate 24 allows the moveable portion 14 to lower at an angle to clear any objects beneath the storage product. As the roller 16 travels through the slot 20 in second plate 26, the moveable portion 14 of the storage product moves downward to its final position.

Figure 10A:
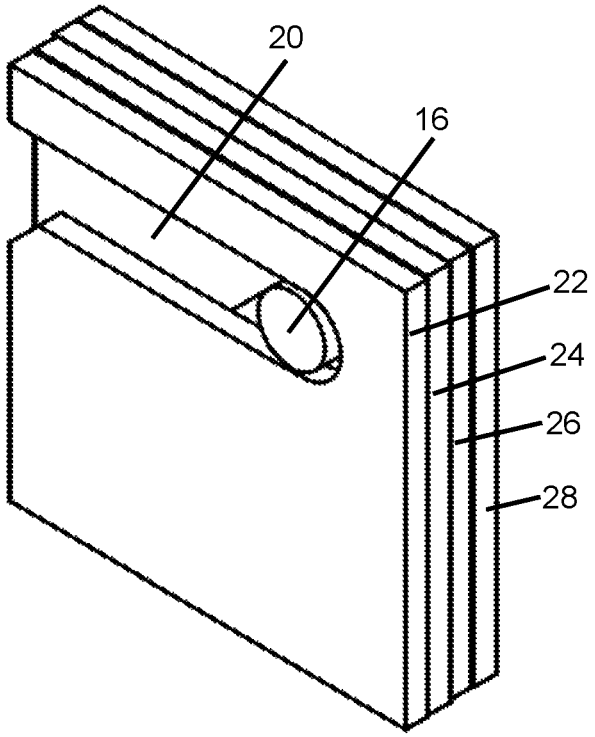
FIGS. 10A-10D are perspective views of the storage product of the third embodiment of the present invention transitioning from the high position to the low position in four sequential steps.
Figure 10B:
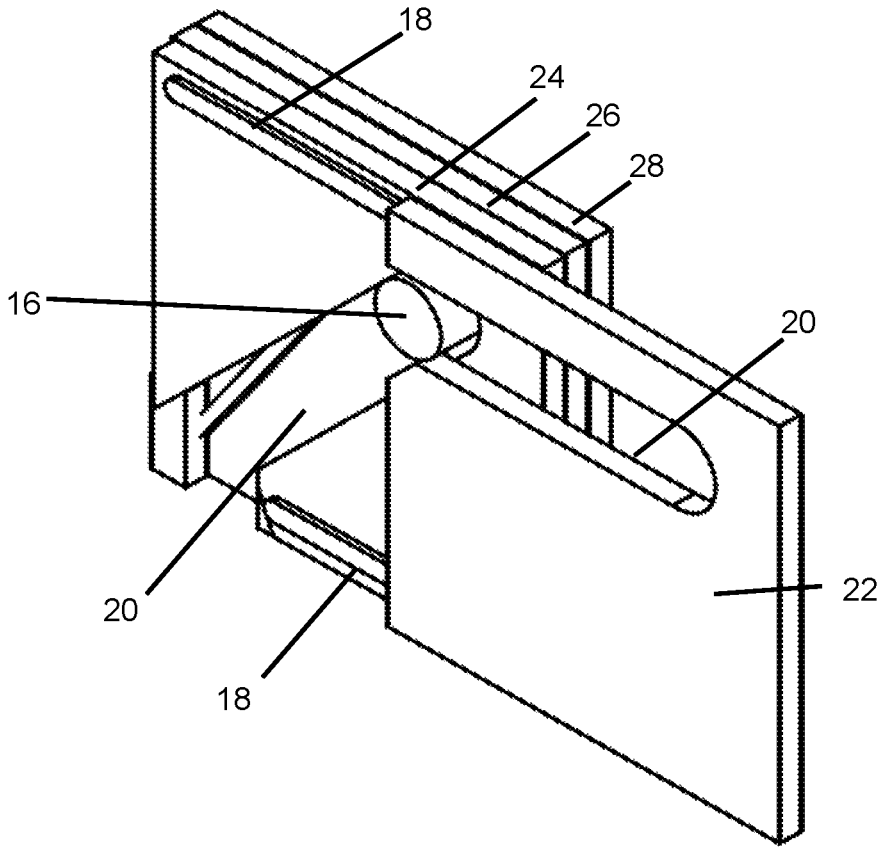
Figure 10C:
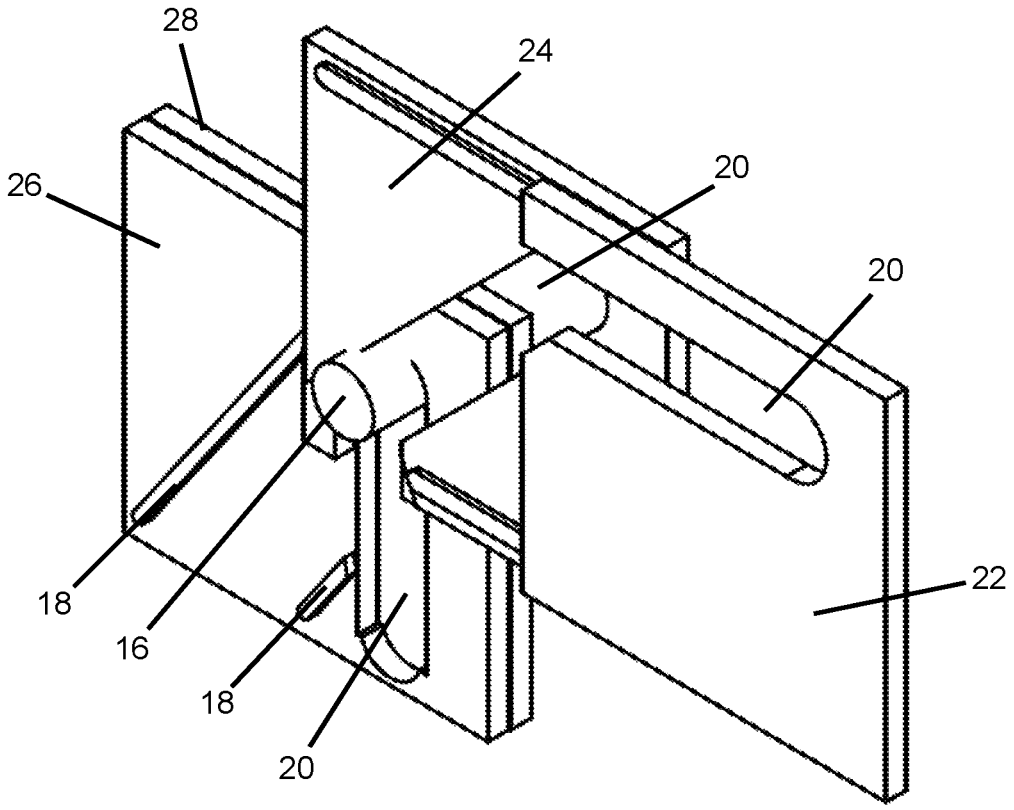
Figure 10D:
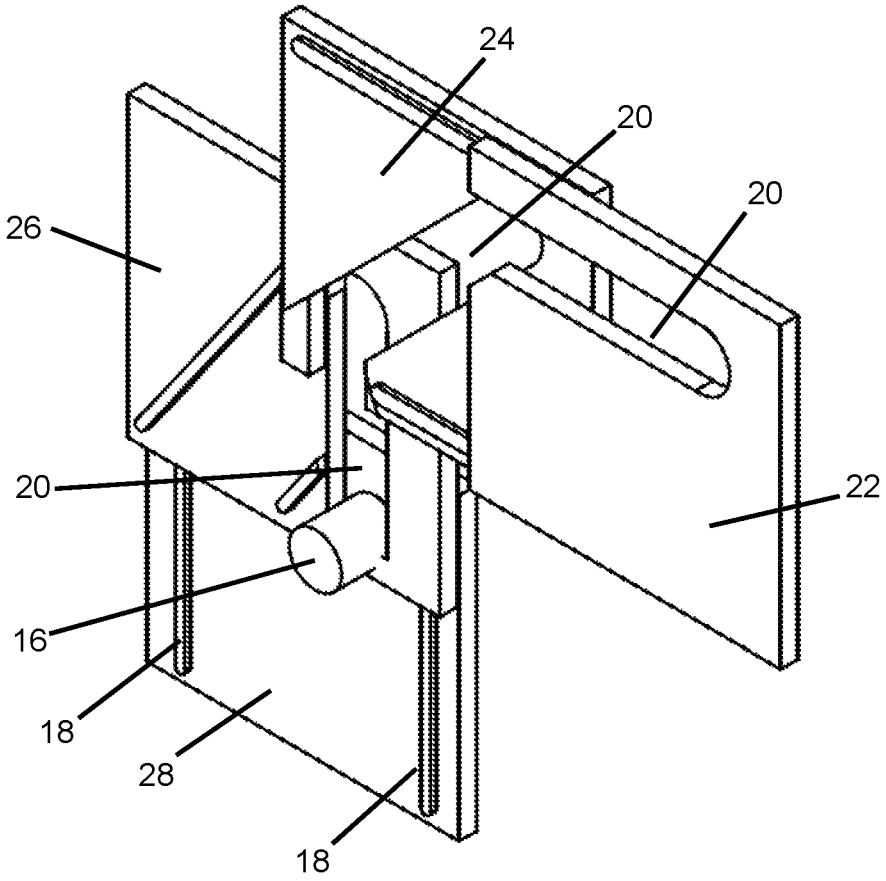
Figure 10E:
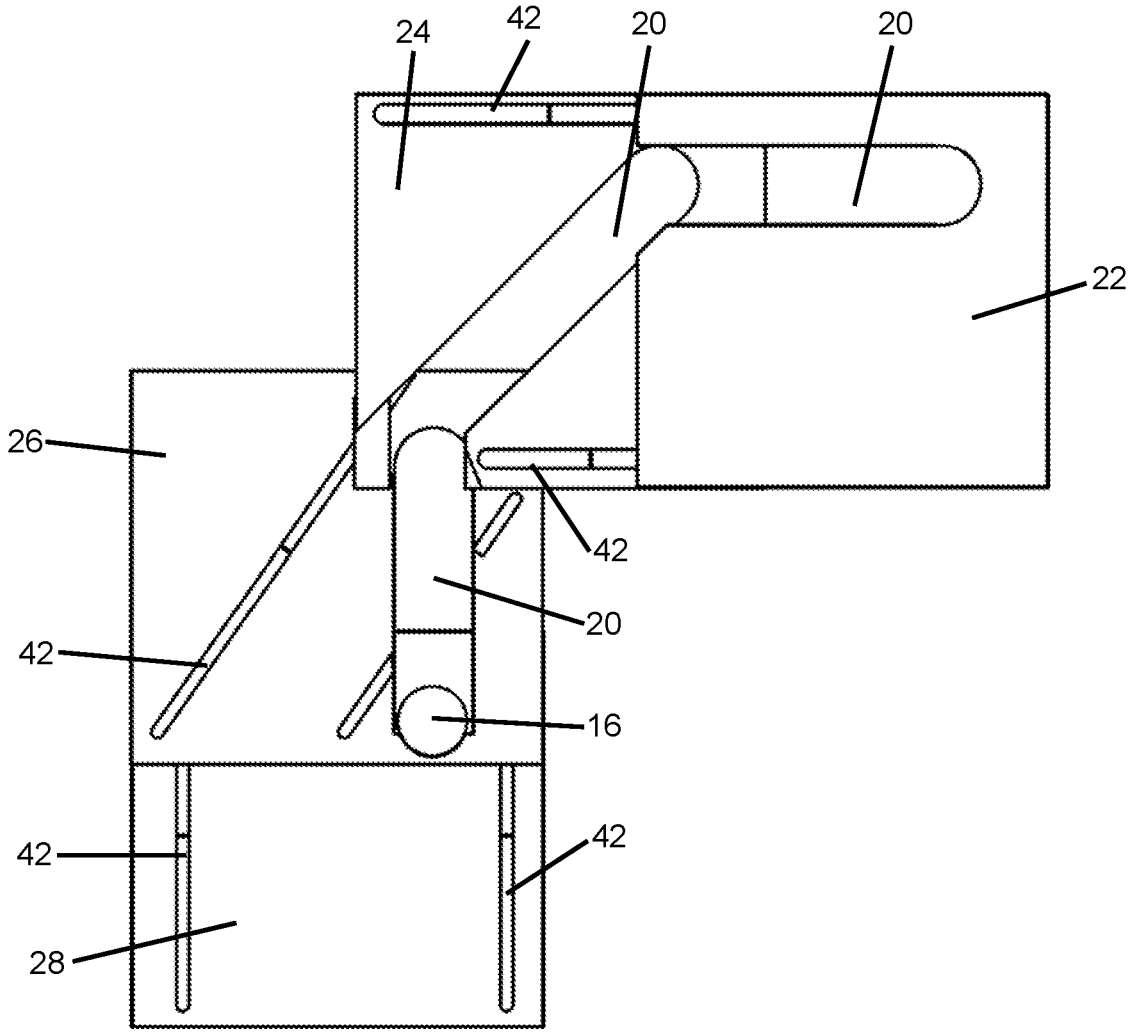
FIG. 10E is a perspective view of the storage product of the third embodiment in the low position with the storage product using drawer slides instead of guide rails.

In this embodiment, in addition to the roller 16 and slots 20 described above, the storage product also uses the guide rails 18 and guide slots 20 described in the first embodiment for controlled movement of the storage product. Alternatively, instead of using guide rails as shown in FIGS. 10B-10D, this embodiment uses conventional drawer slides 42 to guide the direction and distance of travel of each plate. These drawer slides provide physical support for the specified direction of travel (e.g., horizontal, angular, and vertical) and only extend the specified distance needed to allow the roller or peg 16 to travel through the slots 20 in each plate. In FIG. 10E, a first portion of two drawer slides 42 are fastened to the side of the plate 22 (not shown) and a second portion of the two drawer slides 42 are fastened to first plate 24. The interaction of the rails and ball bearing assemblies in the drawer slides allows the first plate 24 to extend horizontally from the plate 22 of the non-moveable portion. On the second plate 26, there is one drawer slide above a guide rail 18 that allows the second plate 26 to travel for a predetermined distance at a downward angle. On the third plate 28, there are two drawer slides that, when extended, allow the third plate to move downward for a predetermined distance and thus lower the moveable portion 14 (whose sides are actually the third plate 28) to make the storage container accessible.

Figure 11:
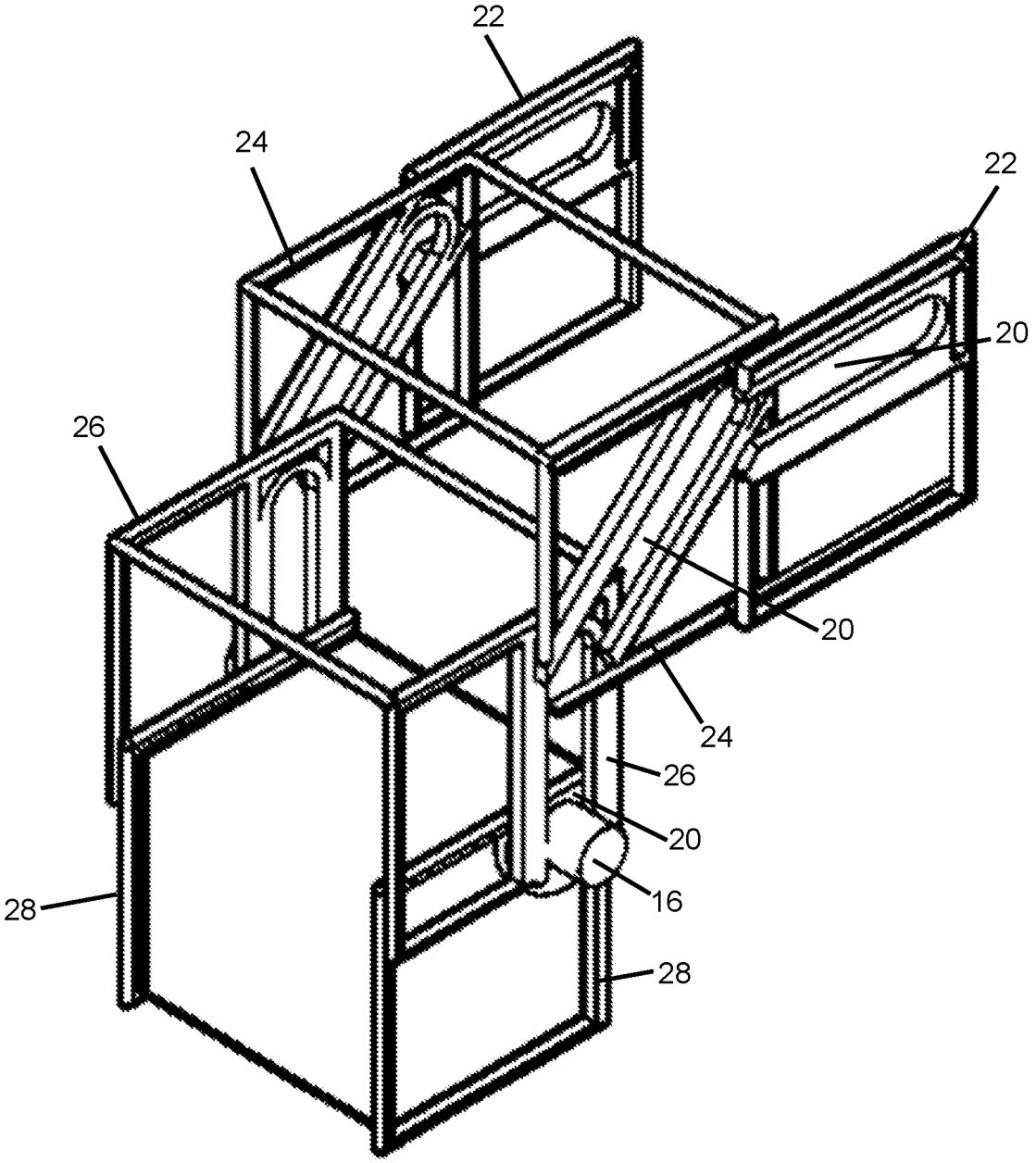
FIG. 11 is a perspective view of the fourth embodiment of the storage product of the present invention.

In a fourth embodiment, instead of using solid materials for the various plates as used in the third embodiment, the plates are merely frames, as shown in FIG. 11. As a result, the plates weigh less and have increased strength. In addition, because of the reduction in materials, there are lower manufacturing costs.

Figure 12A:
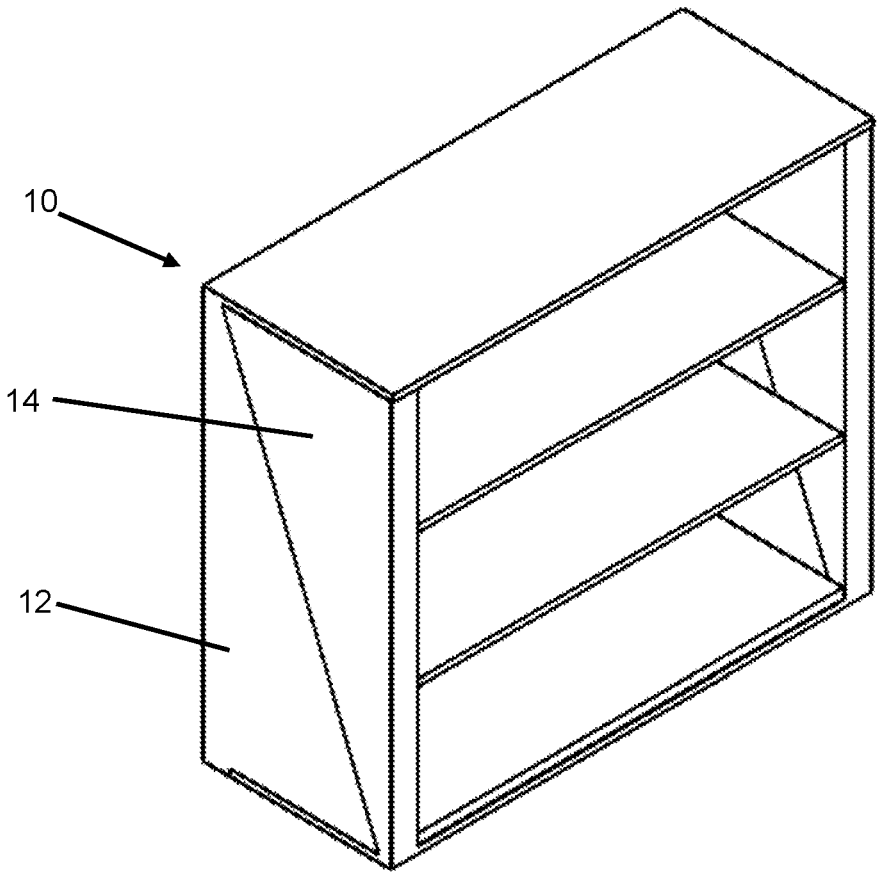
FIG. 12A is a perspective view of the fifth embodiment of the storage product of the present invention in the high position.
Figure 12B:
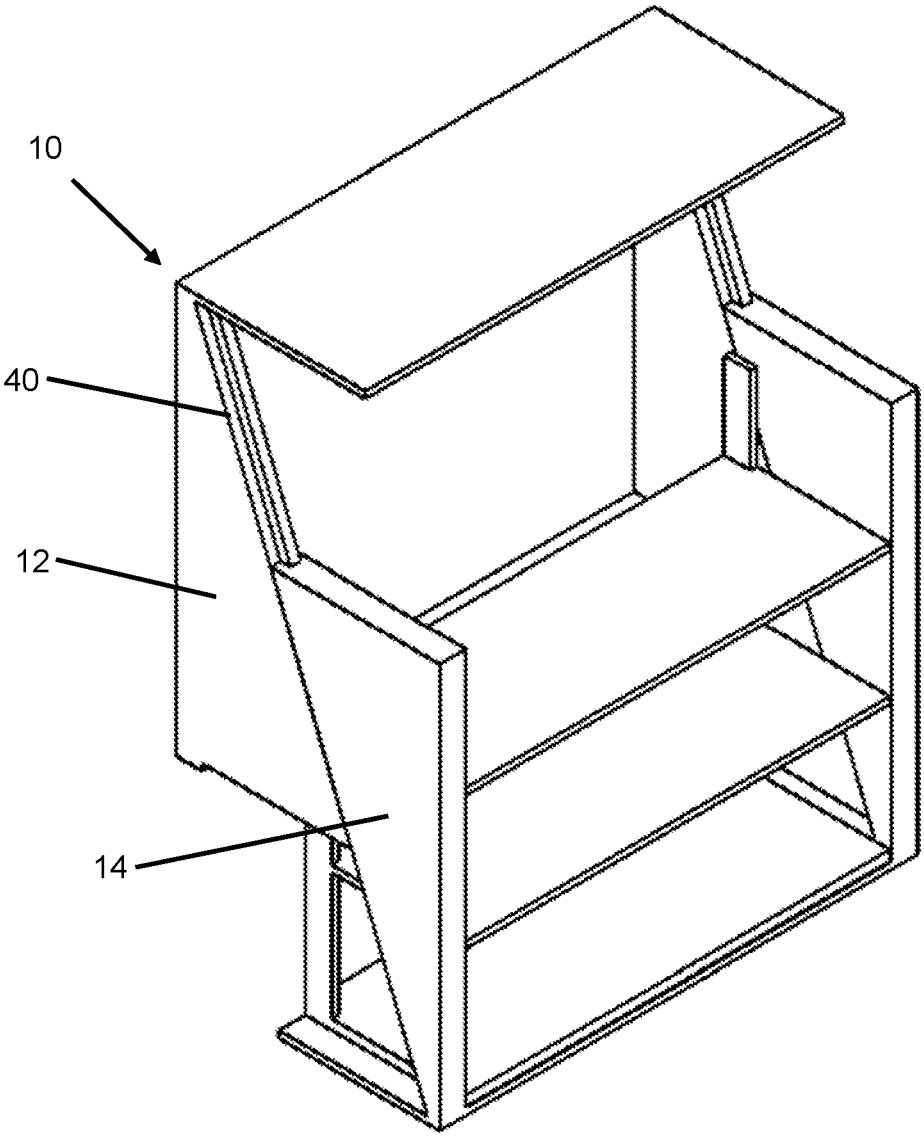
FIG. 12B is a perspective view of the fifth embodiment of the storage product of the present invention in the low position.
Figure 13A:
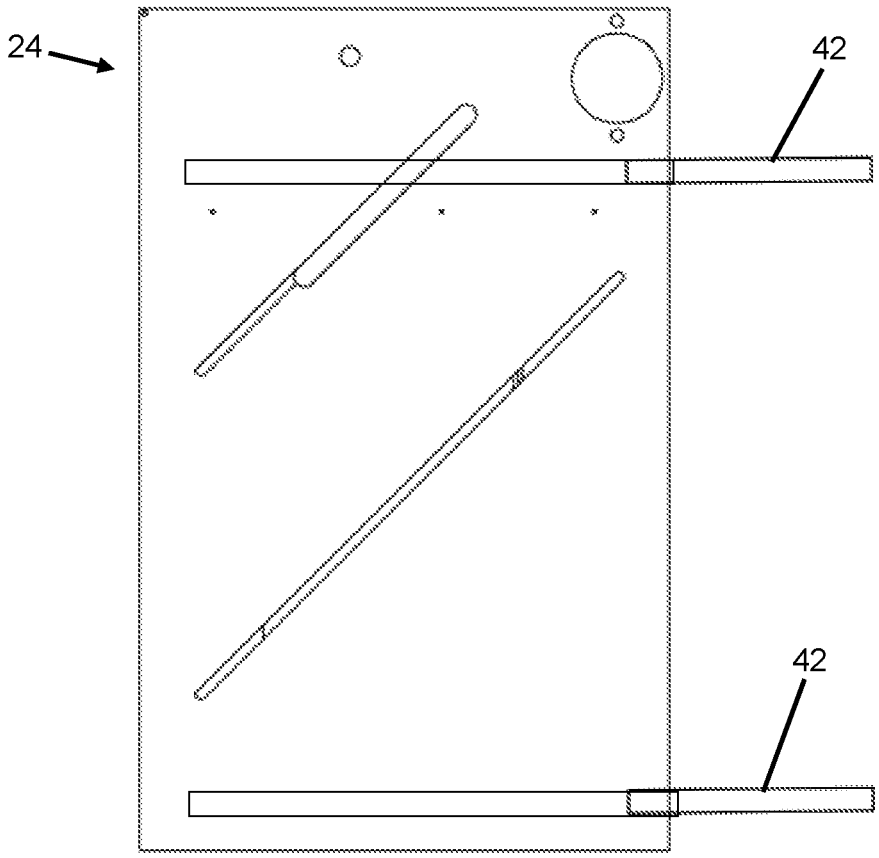
FIGS. 13A-13H are side views of the plates of the storage product of the second embodiment of the present invention.
Figure 13B:
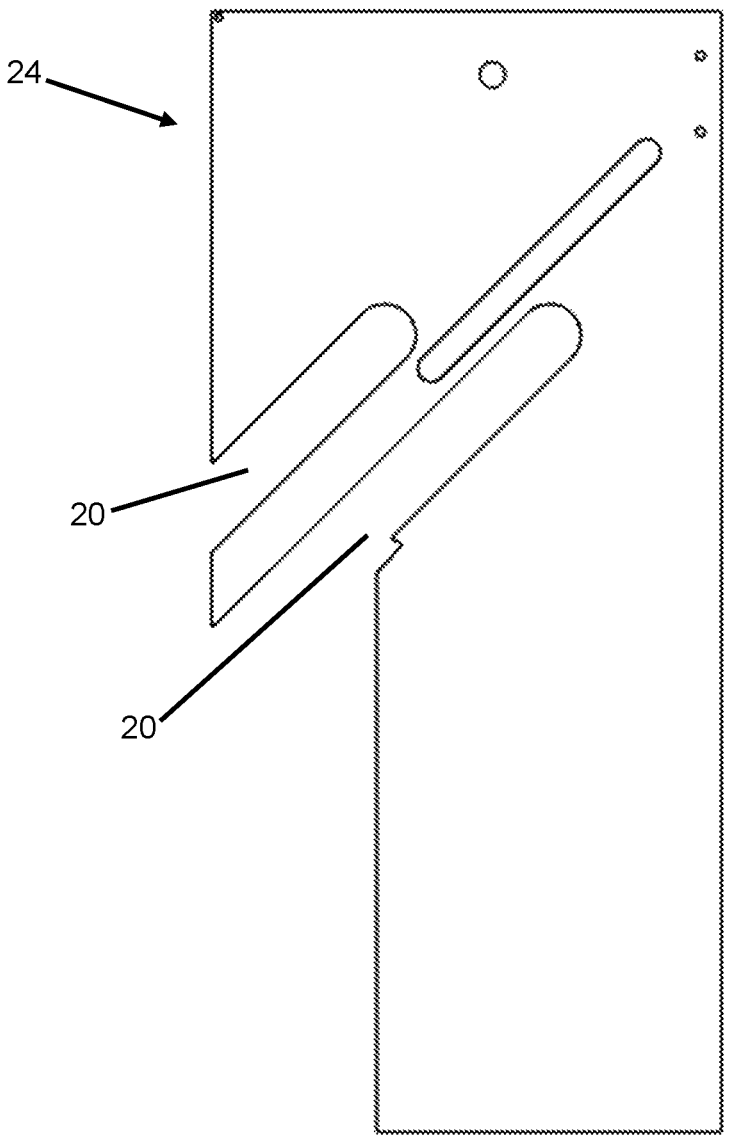
Figure 13C:
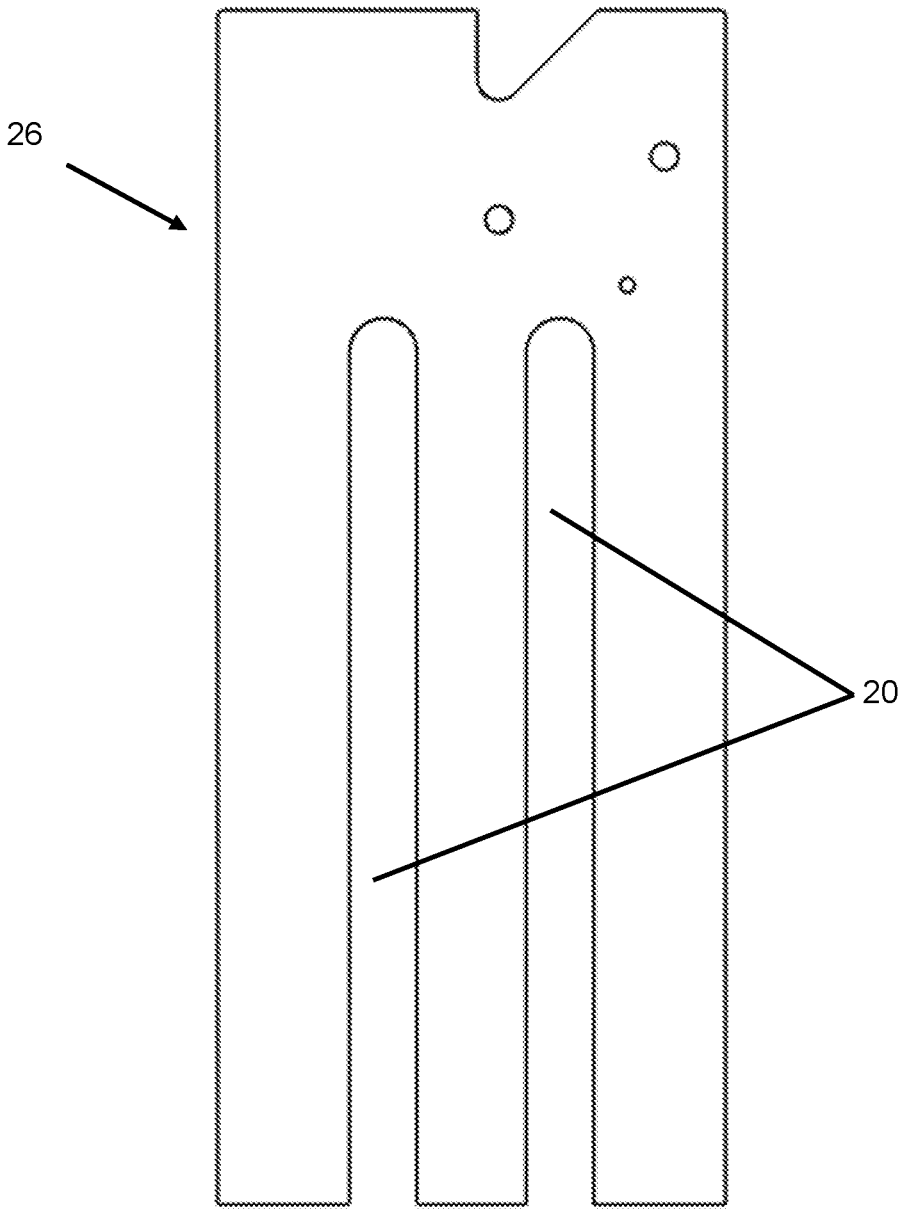
Figure 13D:
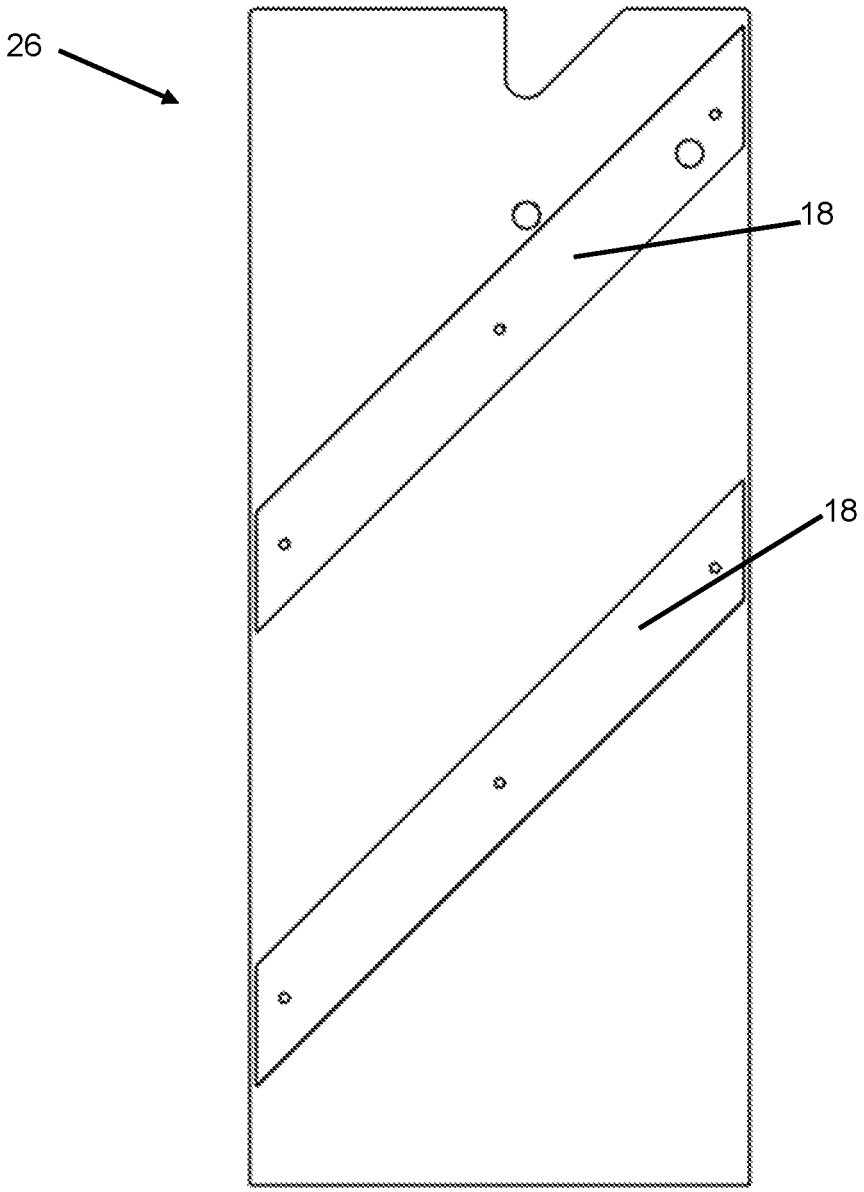
Figure 13E:
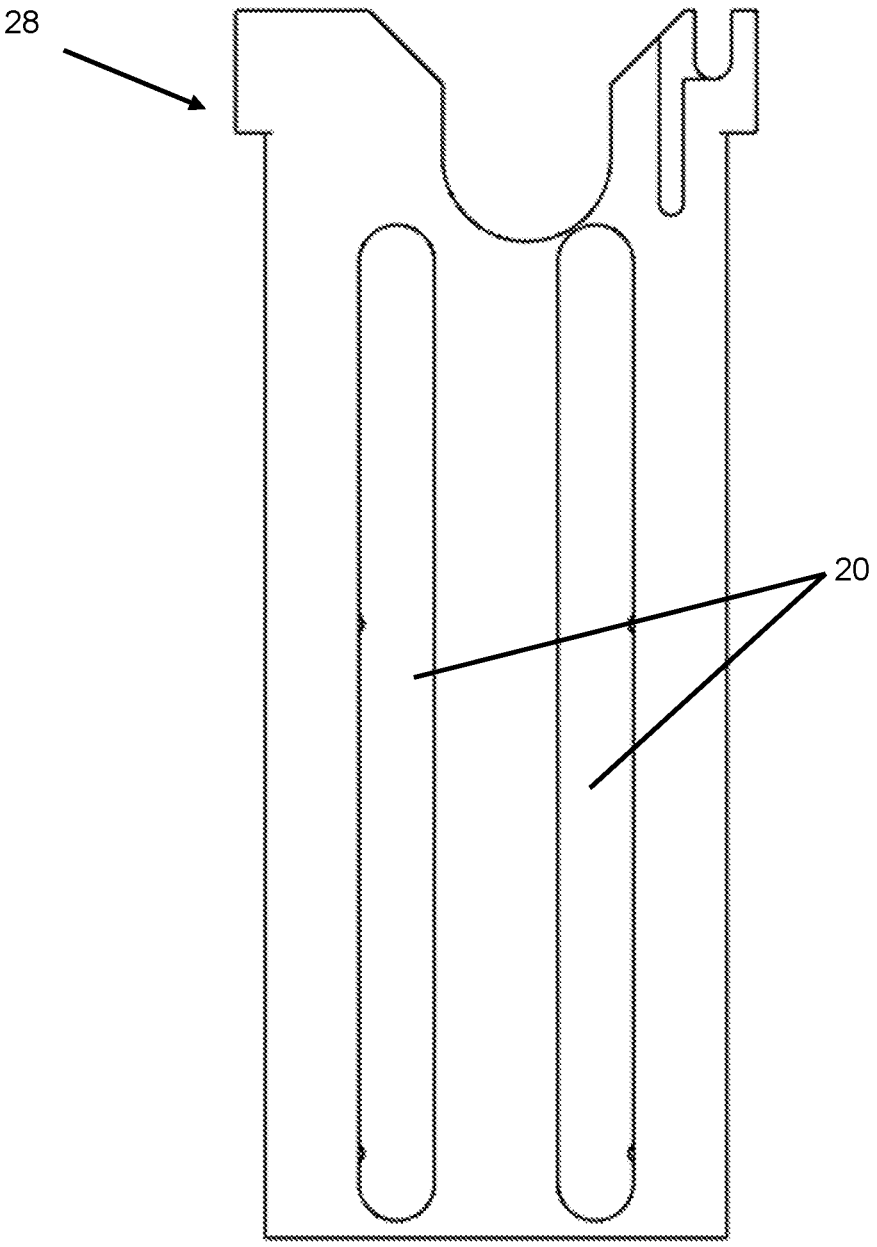
Figure 13F:
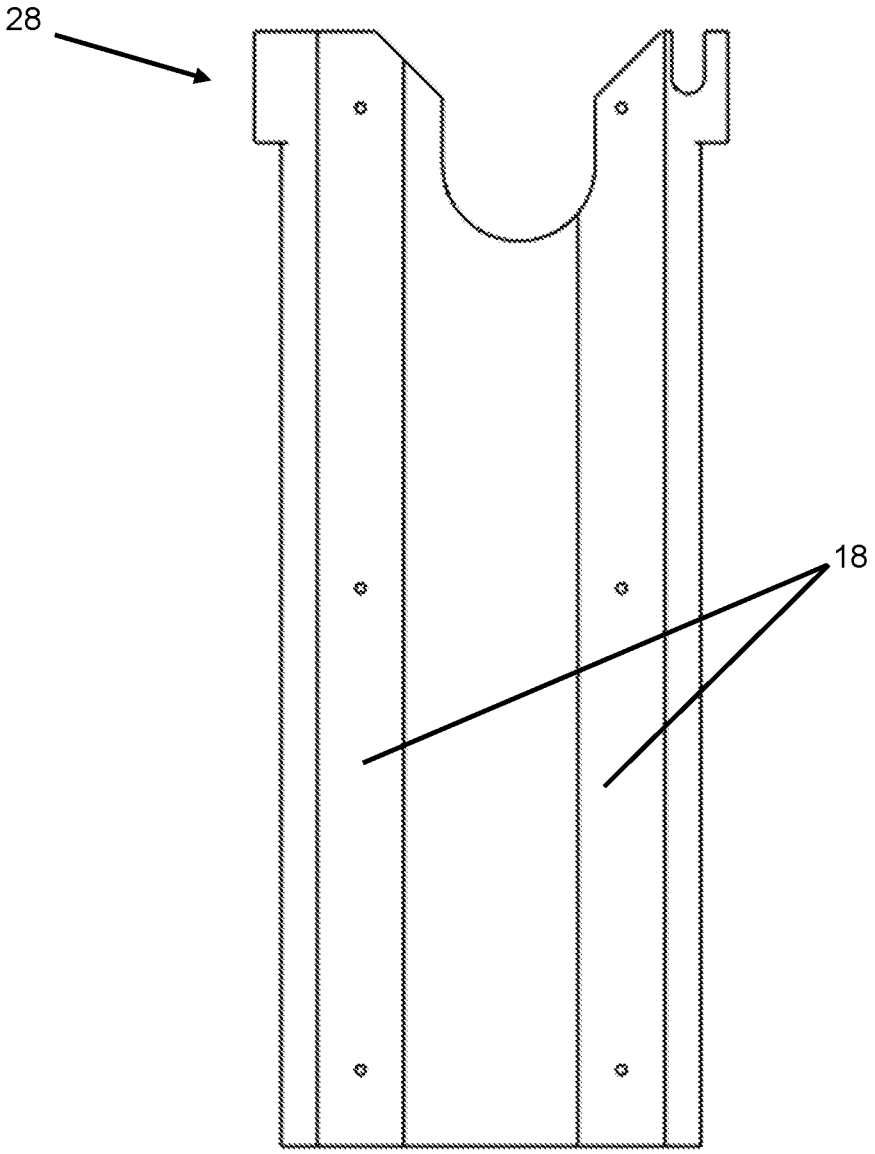
Figure 13G:
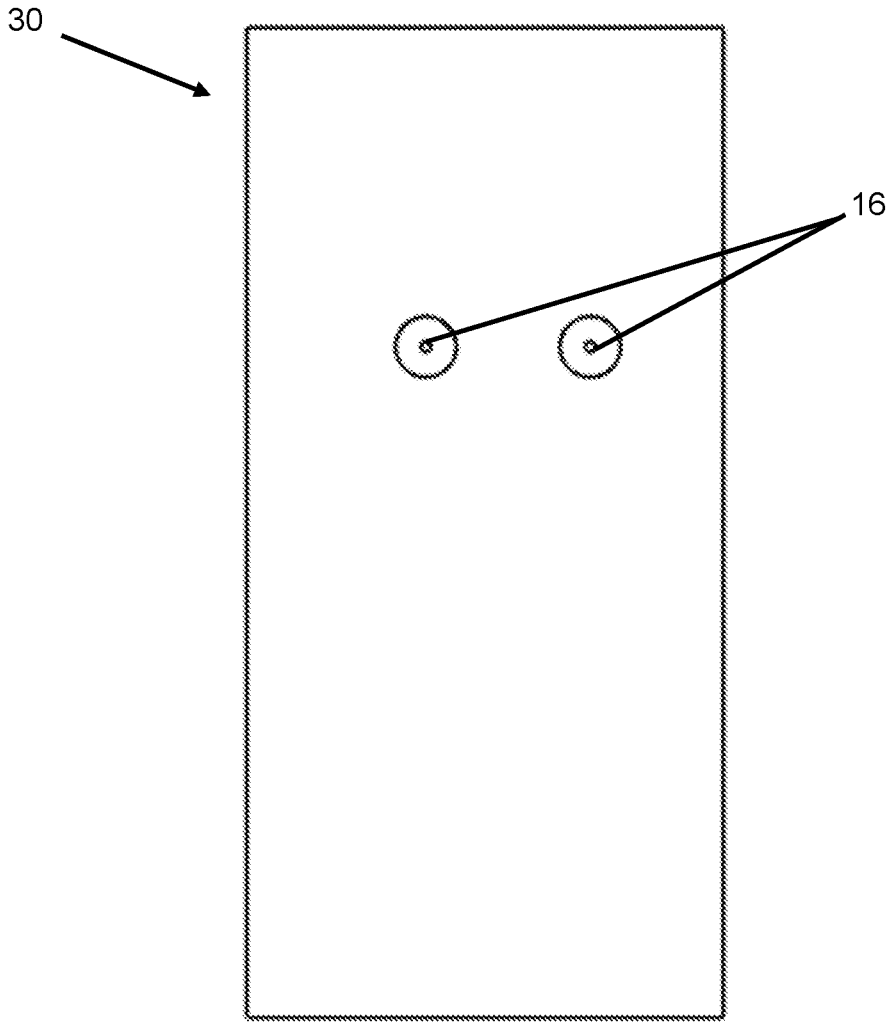
Figure 13H:
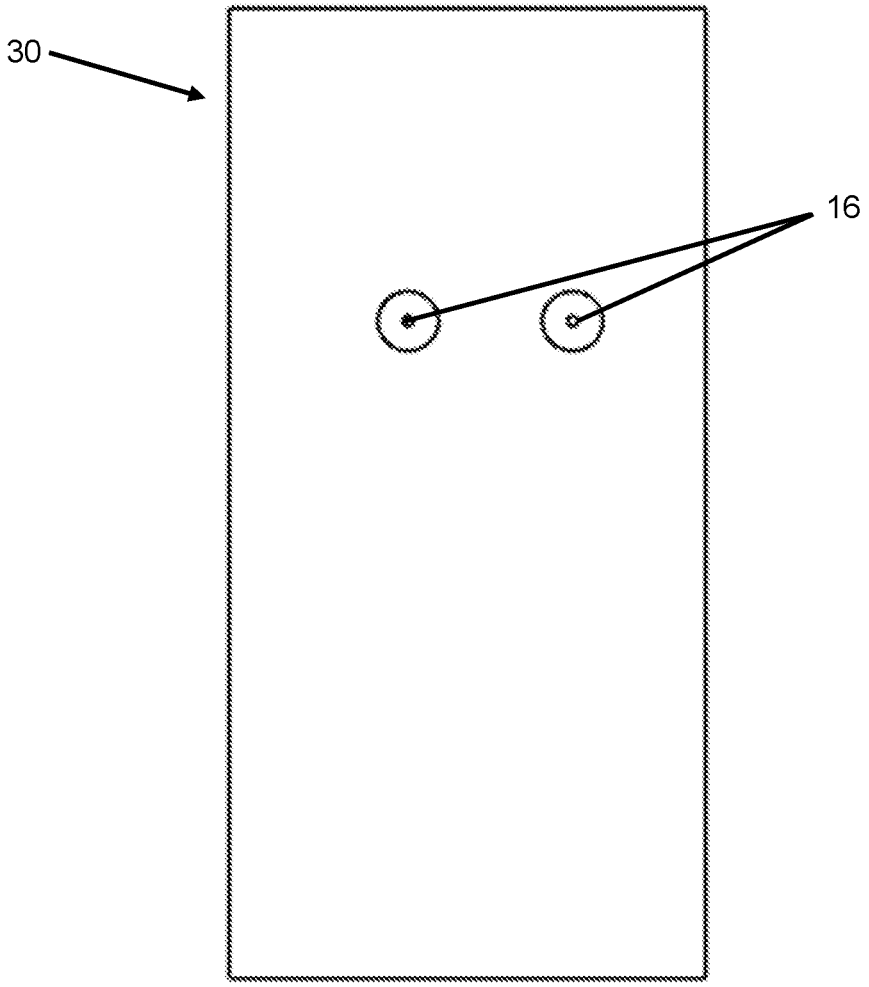

In a fifth embodiment, the storage product is lowered in a single direction, as shown in FIGS. 12A-12B. In this embodiment, a motor and cable system located in the back of the non-moveable portion 12 of the storage product releases tension on cables and lowers the moveable portion 14 of the storage product (which is the front portion of the cabinet) along an angled slide plate 40. When the cable tension is released, gravity and the weight of moveable portion 14 of the storage product and its contents causes the moveable portion 14 to slide down the angled slide plate 40 to a lower level. The lowering speed is controlled by the motor maintaining tension on the cables. When the motor is activated again, the motor creates cable tension to pull the moveable portion 14 back to its original position along the slide plate 40.

While the particular positioning of rails 18 and slots 20 on or in the inner surface or outer surface of certain plates 22, 24, 26, 28, 30, has been described above in the specific embodiments, it should be understood that the positioning of the rails and slots may vary from plate to plate. For example, FIG. 4 shows an alternative first embodiment with a different configuration of rails 18 and slots 20. It should also be understood that the thickness of the rails 18 and depth of the slots 20 may vary depending on desired strength of the plates, the type of material used to construct the plates, and other design considerations. Each plate experiences a slightly different force while lowering and raising because of the direction of movement it is supporting and because the overall weight needing to be supported increases with the extension of plates as the storage product lowers.

In a sixth embodiment, as shown in FIGS. 14A-15B, the storage product 10 is a single shelf. This embodiment provides accessibility to single shelf above-head-height storage in situations where only a single shelf is needed or where this is the only embodiment that meets the available space in a residence or workplace.

A base plate 44 is mounted underneath two custom drawer rails 46 and is secured to the two custom drawer rails 46 using screws or nuts and bolts. The base plate 44 (also referred to as the non-moveable portion of the storage product) may be secured to a wall using conventional mounting technology that would be well-known to a person skilled in the art. The shelf 48 (also referred to as the moveable portion of the storage product) is mounted on top of the rail base 50 and secured with screws or nuts and bolts. In one embodiment, the shelf if a wooden plank. A user may select the style, pattern, and color of the material to be used for the shelf as long as it meets the requirements needed to support the intended weight of items to be stored. The lowering and raising of the shelf may be performed either manual or by using motors to perform the movement of components. In the manual version, a handle is located on the front of the shelf 48 which allows a user to grasp the handle and pull outward to cause the shelf 48 to extend horizontally. Custom drawer slides 52 are mounted to the drawer rails 46, and a pivot assembly 54 is fixed on top of the drawer slides 52. The pivot assembly 54 is a shaft that runs through an outer housing and has a tension spring that governs the rotation speed of the shaft. The custom drawer slides 52 move horizontally forward and backward along the custom drawer rails 46, which moves the shelf 48 and the outer housing to move forward and backward horizontally.

Figure 14A:
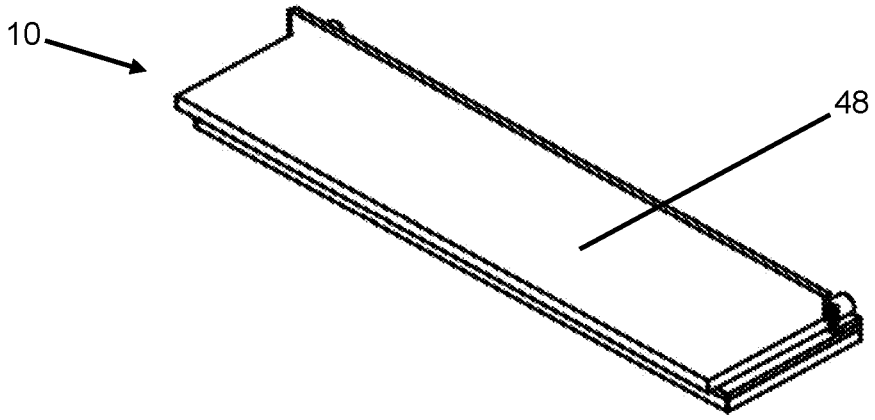
FIG. 14A is perspective view of the storage product of the sixth embodiment of the present invention in the high position.
Figure 14B:
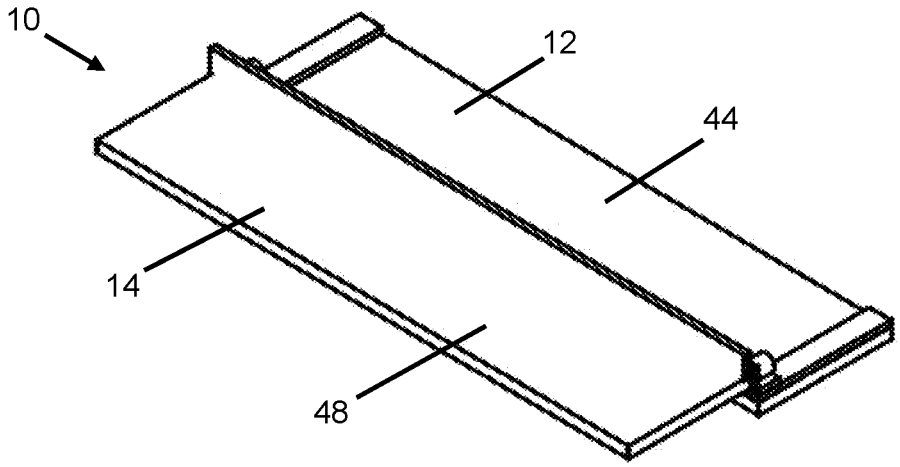
FIG. 14B is a perspective view of the storage product of the sixth embodiment of the present invention transitioning from the high position to the low position.
Figure 14C:
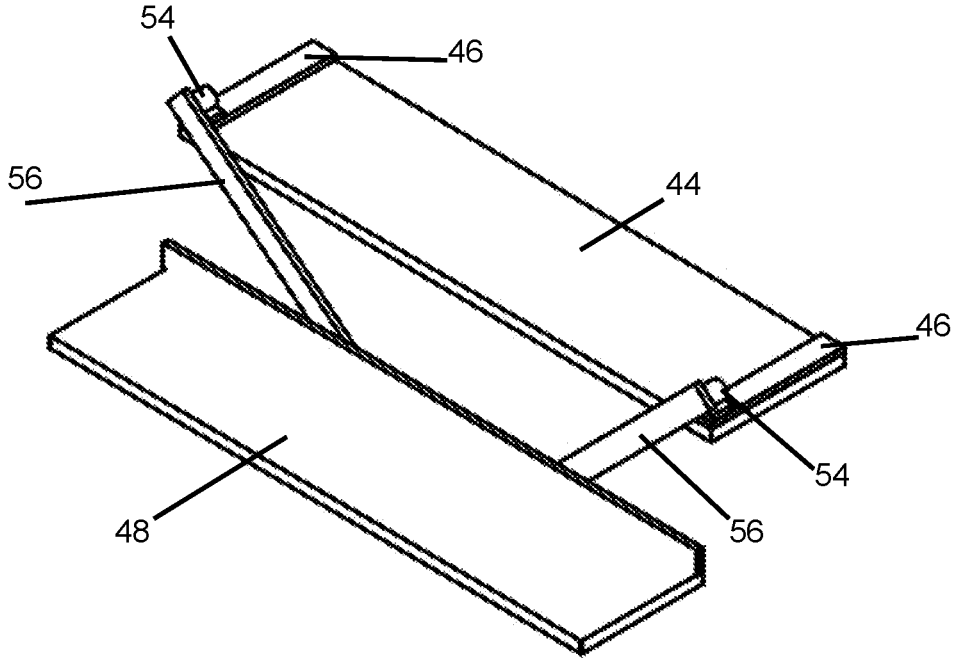
FIG. 14C is a perspective view of the storage product of the sixth embodiment of the present invention transitioning from the high position to the low position.
Figure 14D:
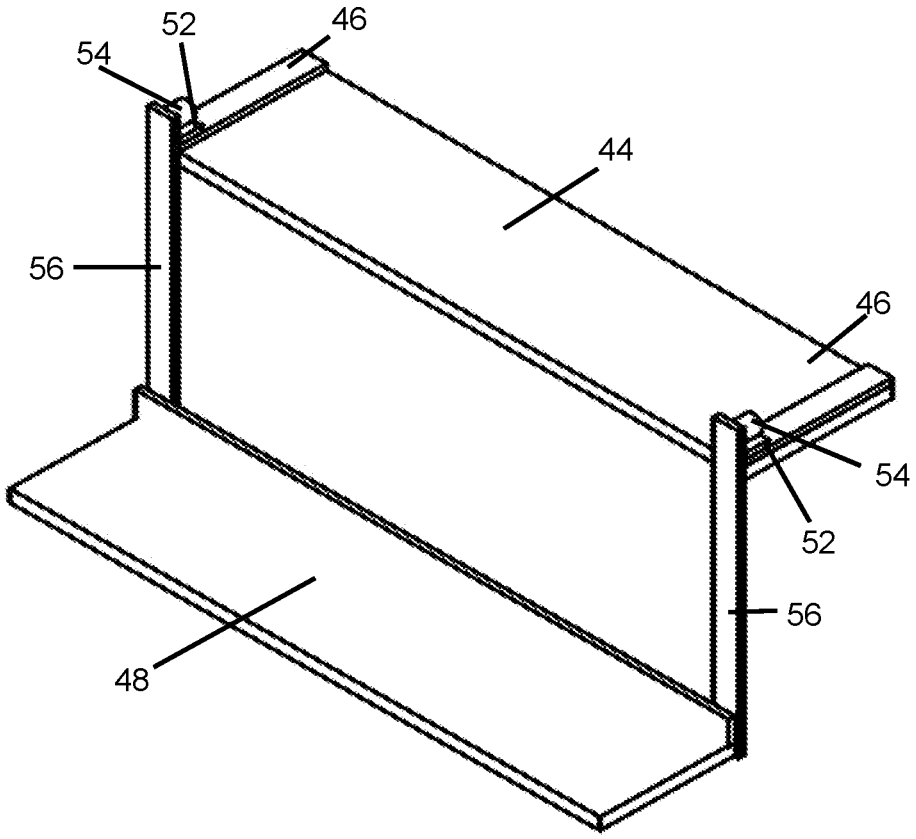
FIG. 14D is a perspective view of the storage product of the sixth embodiment of the present invention in the low position.
Figure 15A:
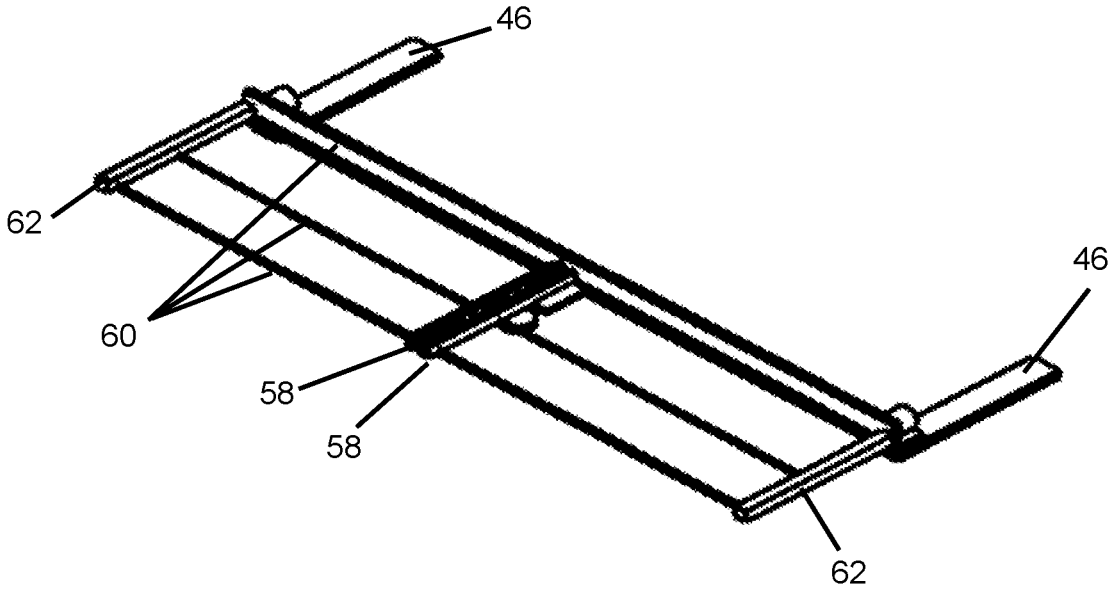
FIG. 15A is a perspective view of the storage product of the sixth embodiment of the present invention transitioning from the high position to the low position with the base plate and shelf omitted.
Figure 15B:
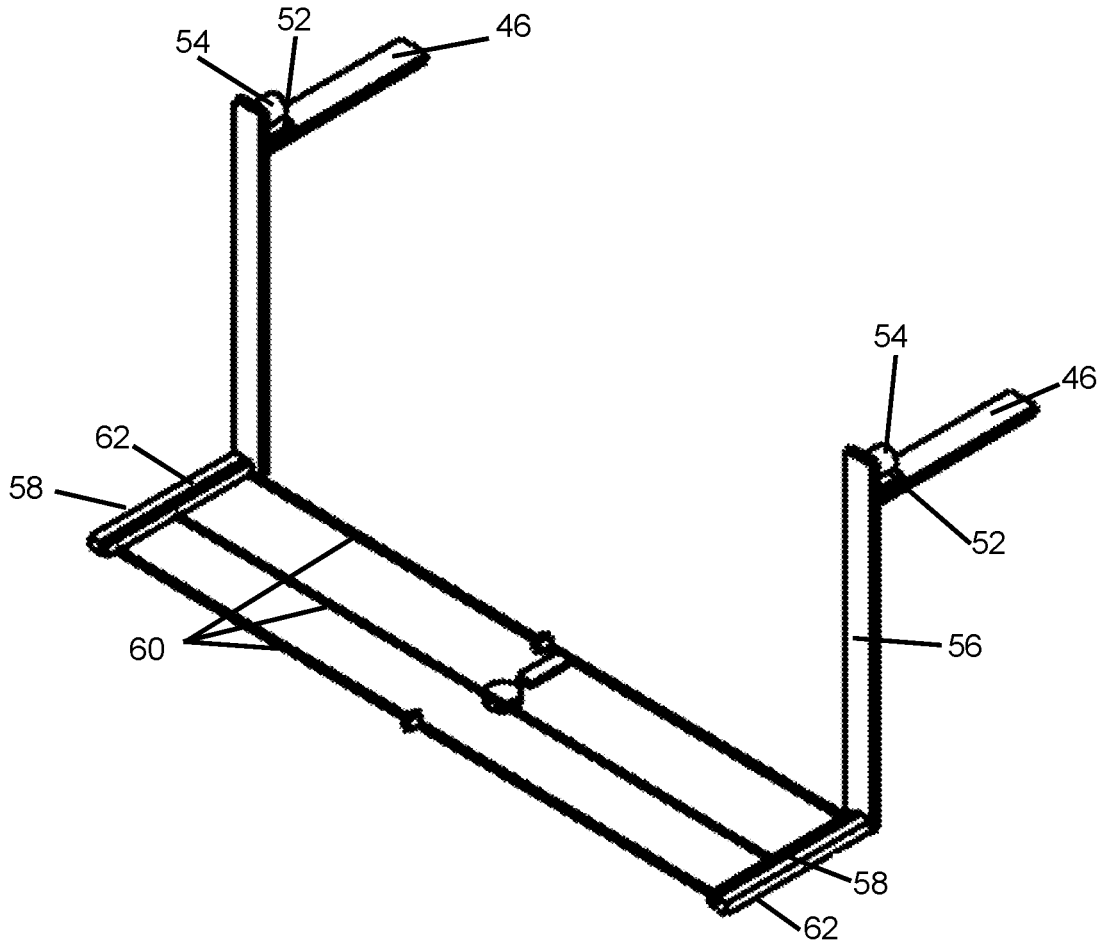
FIG. 15B is a perspective view of the storage product of the sixth embodiment of the present invention in the low position with the base plate and the shelf omitted.

Whenever a user desires to lower the shelf 48, the user pulls the shelf 48 forward, along the custom drawer rail 46 to a predetermined point at which the lowering arms 56 and the shelf 48 are clear of the base plate 44 and free to lower, as shown in FIGS. 14B-14C. The lowering arms 56 then pivot downward and outward causing the shelf 48 to lower. At the same time, each rail slide 58 slides outward along the rail set 60 under the shelf 48, as shown in FIGS. 15A-15B. When the lowering arms 56 have fully pivoted outward, the rail slides 58 have traveled the full distance of the rail set 60 and are pressing against and stopped by the rail base 62, the shelf 48 is fully lowered, as shown in FIG. 15B. To raise the shelf 48, the steps described above performed in reverse.

The motion controlled wall-mounted storage product of the present invention preferably includes a touch-screen for controlling the storage product. Alternatively, the storage product may also include voice recognition for controlling the storage product. In one embodiment, use of the storage product requires authentication. The storage product includes back-up batter power in the event of a power outage. The speed at which the moveable portion of the storage product is lowered and raised is controllable by the user in addition to the preferred height to which the moveable portion is lowered. The storage product detects objects in the travel path of the moveable portion and onboard intelligence stops movement of the moveable portion when the objects in the travel path are detected. An internal light and camera are preferably positioned inside the storage product to make it easier to view the contacts in the storage product. The storage product may include an audible beacon to assist a vision impaired user with determining the location of the storage product. The storage product may also be operated using specific physical gestures (e.g., customer waiving her arm twice). The storage product is capable of detecting and notifying a user when items placed in the storage product exceed a safe weight.

The storage product is connected to remote management centers via the Internet for operational monitoring and problem resolution (assistive services). The storage product also includes a WiFi hotspot feature. The storage product may also include an onboard VoIP for children of users aging in place to monitor and communicate to with their parents. The storage product preferably is connected to alarm systems for intrusion detection and smoke detection and may include an alternative method to contact first responders. For example, the storage product may include a first responder alert that can be activated by an assistive canine.

In one embodiment, the storage product may be a refrigerator or freezer for perishable item storage. The storage product may also include a fire-proof and/or ruggedized exterior.

Because people with disabilities have a lower rate of technology adoption than those without disabilities, may be unable to afford technology due to economic disparities, or live in rural areas where broadband is unaffordable or unavailable, the storage product's Internet connectivity enables digital communications to those homes (many for the first time) and has the potential to serve as a platform through which researchers and healthcare professionals will gain access to a medically underserved demographic. By installing components in the storage product that support advanced digital services, the storage product can facilitate patient-healthcare provider communication, be used for detection and assessment of a broad array of exposures, support delivery of science and health curricula, and be used to introduce and evaluate behavioral and medical interventions. Through collaborative partnerships and further research and development, the storage product can be used to collect data for studies of a demographic to which there may have been limited access in the past, which could then lead to big data science and offer an opportunity to deliver Internet of behavior interventions and A. I. assisted healthcare.

By designing the storage product as a method for customers to access digital services, many potential risks and challenges will be avoided because: (1) the storage product is a designated device and provides a more stable and reliable platform for the delivery of digital services than a personal computing device, (2) digital services have a high level of usability and lead to a high user adoption rate because their use does not require the level of learning needed to effectively use new personal computing devices and software applications, and (3) delivering digital services through the storage product avoids the risk of devices being stolen or lost since the storage product is secured to the walls of the home.

The storage product of the present invention may be connected over the Internet to remote monitoring centers, and individuals may subscribe to optional add-on enhanced digital services. Assistive services include remote monitoring of the storage product's operation, and a service where service center personnel lowers the storage product at the user's request. Enhanced digital services include providing an alternate method to contact first responders, connectivity with alarm systems for motion and smoke detection, and operating as a WiFi hotspot.

The storage product of the present invention includes hardware to enable it to serve as an intelligent endpoint through which telehealth services can be delivered to customers. By enabling the storage product to communicate with telehealth platforms, these platforms can use the storage product as a digital delivery endpoint for medical services. Installing the storage product's cameras and monitors on the inside of the doors of the storage product will minimize their visibility to the user and minimize any sense of intrusion.

Much discussion has occurred in recent years about the use of digital interventions and their benefits. The storage product could support digital intervention by use of the cameras installed in the storage product transmitting images to a remote software platform that medical personnel can use to observe behavior of patients in their homes in order to identify opportunities for medical or behavioral interventions. The storage product could also be integrated with mental health platforms.

When the storage product is installed in a large number of homes of people with physical disabilities and connects these homes to the Internet, research professionals will have digital access to a demographic that have been previously unavailable to them, creating the opportunity to gather new data from which they could derive new insights. A variety of organizations could use the assistive offer as a platform to support their research projects and studies. These observation components may either be installed in the storage product itself or operate as peripherals that would collect and transmit data via encrypted protocols to remote scientific research platforms for storage, review, and analysis.

Currently, research and development for A. I. assisted healthcare is being conducted by organizations such as IBM and Stanford University. The Stanford Partnership for AI-Assisted Care is currently running projects for intelligent hand hygiene support, healthcare conversational agents, and intelligent senior well-being support. The Cork Institute of Technology has published papers based on research for AI technology to visually detect strokes by observing patients' faces. Other research is being developed for AI to assist with detecting Alzheimer's by observing a person's gait over video streams. By partnering with organizations developing these technologies, the storage product of the present invention with A. I. can be integrated with assisted healthcare platforms and deliver these services.

The digital services capable of being offered by the storage product has value on the individual level, healthcare level, research level, and societal level. On the individual level, the digital services provide the following value: increased in-home accessibility, safety, convenience, enhanced quality of life, support independent living, and access to digital services. On the healthcare level, the digital services provide the following value: reduce fall related injuries, digital health services delivery, improve healthcare delivery, improve healthcare outcomes, efficient healthcare delivery, and improved patient experience. On the societal level, the following benefits can be realized: removal of economic and geographic barriers to healthcare, improved access to health services, reduced exposure to infectious diseases, narrow the digital divide, and improved quality of life for many. Finally, on the research level, the digital services provide the following benefits: faster and more reliable research and development, path to big data and A. I. assisted healthcare, predictive modeling, statistical tools and algorithms, and improve research outcomes.

The present invention has been described with reference to certain preferred and alternative embodiments that are intended to be exemplary only and not limiting to the full scope of the present invention as set forth in the appended claims.

I claim:

1. A motion controlled wall-mountable storage product, comprising:

a storage product comprising a wall-mountable portion and a moveable portion, wherein said moveable portion is operable to hold goods, a set of first plates connected to said wall-mountable portion, wherein said set of first plates is moveable in a first direction relative to said wall-mountable portion;

a set of second plates connected to said set of first plates, wherein said set of second plates is moveable in a second direction relative to said set of first plates;

a set of third plates connected to said set of second plates, wherein said set of third plates is moveable in a third direction relative to said set of second plates, wherein said moveable portion is connected to said set of third plates and is moveable relative to said set of third plates, wherein said moveable portion is lowerable below said wall-mountable portion and said set of third plates.

2. The storage product of claim 1, wherein said set of first plates is connected to said wall-mountable portion via pegs and slots or via rails and slots, wherein said set of second plates is connected to said set of first plates via pegs and slots or via rails and slots, wherein said set of third plates is connected to said set of second plates via pegs and slots or via rails and slots, wherein said moveable portion is connected to said set of third plates via pegs and slots or via rails and slots.

3. The storage product of claim 1, wherein said set of first plates comprises a right first plate and a left first plate, wherein said right first plate and said left first plate are moveable simultaneously.

4. The storage product of claim 3, wherein an inner surface of said right first plate comprises an angular slot.

5. The storage product of claim 4, wherein said set of second plates comprises a right second plate and a left second plate, wherein an outer surface of said right second plate comprises a rail configured to be received by said angular slot of said right first plate.

6. The storage product of claim 5, wherein an inner surface of said right second plate comprises a vertical slot.

7. The storage product of claim 6, wherein said set of third plates comprises a right third plate and a left third plate, wherein an outer surface of said right third plate comprises a rail configured to be received by said vertical slot of said right second plate.

8. The storage product of claim 1, wherein an inner surface of said wall-mountable portion comprises a horizontal slot.

9. The storage product of claim 8, wherein an outer surface of said right first plate comprises a rail configured to be received by said horizontal slot of said wall-mountable portion.

10. The storage product of claim 1, further comprising a first box, a second box, and a third box, wherein said first box comprises said set of first plates, said second box comprises said set of second plates, and said third box comprises said set of third plates.

11. The storage product of claim 10, wherein said third box is positioned inside said second box, wherein said second box is positioned inside said first box.

12. The storage product of claim 11, wherein said moveable portion is positioned inside said wall-mountable portion when said storage product is in said high position.

13. The storage product of claim 10, wherein said storage product comprises a high position and a low position.

14. The storage product of claim 1, further comprising a first motor and a second motor.

15. A motion controlled wall-mountable storage product, comprising:

a storage product comprising a wall-mountable portion and a moveable portion, wherein said moveable portion is operable to hold goods, wherein said moveable portion further comprises a first peg and a second peg, wherein said first peg and said second peg are attached on opposite sides of said moveable portion;

a right first plate and a left first plate connected to said wall-mountable portion, wherein said right first plate and said left first plate are moveable in a first direction relative to said wall-mountable portion, wherein an inner surface of each of said right first plate and said left first plate comprises an angular slot configured to receive said first peg or said second peg;

a right second plate connected to said right first plate and a left second plate connected to said left first plate, wherein said right second plate and said left second plate are moveable in a second direction relative to said right first plate and said left first plate, wherein an inner surface of each of said right second plate and said left second plate comprises a vertical slot configured to receive said first peg or said second peg;

a right third plate connected to said right second plate and a left third plate connected to said left second plate, wherein said right third plate and said left third plate are moveable in a third direction relative to said right second plate and said left second plate, wherein an inner surface of each of said right third plate and said left third plate comprises a vertical slot configured to receive said first peg or said second peg, wherein said moveable portion is connected to said right third plate and said left third plate and is moveable relative to said right third plate and said left third plate.

16. The storage product of claim 15, further comprising a first drawer slide connected to said non-moveable portion and an outer surface of said right first plate, and further comprising a second drawer slide connected to said non-moveable portion and an outer surface of said left first plate.

17. The storage product of claim 15, wherein an outer surface of said right second plate comprises a rail configured to connect said right second plate to said right first plate, wherein an outer surface of said left second plate comprises a rail configured to connect said left second plate to said left first plate.

18. The storage product of claim 15, wherein an outer surface of said right third plate comprises a rail configured to connect said right third plate to said right second plate, wherein an outer surface of said left third plate comprises a rail configured to connect said left third plate to said left second plate.

19. The storage product of claim 15, wherein said moveable portion further comprises a third peg and a fourth peg attached to said opposite sides of said moveable portion, wherein said first peg is adjacent to said third peg and wherein said second peg is adjacent to said fourth peg.

20. The storage product of claim 15, further comprising a motorized system, wherein said motorized system comprises cables and pulleys.

21. A motion controlled wall-mountable storage product, comprising:

a storage product comprising a wall-mountable portion and a moveable portion, wherein said moveable portion is operable to hold goods, a set of first plates connected to said wall-mountable portion, wherein said set of first plates is moveable in a first direction relative to said wall-mountable portion, wherein an inner surface of said set of first plates comprises an angular slot;

a set of second plates connected to said set of first plates, wherein said set of second plates is moveable in a second direction relative to said set of first plates, wherein said inner surface of said set of second plates comprises a vertical slot;

a set of third plates connected to said set of second plates, wherein said set of third plates is moveable in a third direction relative to said set of second plates, wherein said moveable portion comprises said set of third plates.

* * * * *